US005564373A

United States Patent [19]

Hara

[11] Patent Number: 5,564,373

[45] Date of Patent: Oct. 15, 1996

[54] CYLINDER VALVE DRIVE FOR INTERNAL COMBUSTION ENGINE

[75] Inventor: Seinosuke Hara, Atsugi, Japan

[73] Assignee: Unisia Jecs Corporation, Atsugi, Japan

[21] Appl. No.: 420,768

[22] Filed: Apr. 12, 1995

[30] Foreign Application Priority Data

Apr. 12, 1994 [JP] Japan ..... 6-072967
Aug. 10, 1994 [JP] Japan ..... 6-187639

[51] Int. Cl.[6] ..... F01L 13/00

[52] U.S. Cl. ..... 123/90.16; 123/90.17; 123/90.21

[58] Field of Search ..... 123/90.15, 90.16, 123/90.17, 90.21, 90.22, 90.27, 90.48; 251/251, 263

[56] References Cited

U.S. PATENT DOCUMENTS

| | | | |
|---|---|---|---|
| 4,534,323 | 8/1985 | Kato et al. | 123/90.16 |
| 5,113,813 | 5/1992 | Rosa | 123/90.16 |
| 5,203,289 | 4/1993 | Hara et al. | 123/90.16 |
| 5,205,247 | 4/1993 | Hoffman | 123/90.21 |
| 5,275,137 | 1/1994 | Uesugi | 123/90.16 |

FOREIGN PATENT DOCUMENTS

| | | |
|---|---|---|
| 3520859 | 12/1986 | Germany . |
| 4206867 | 9/1993 | Germany . |
| 61-65006 | 4/1986 | Japan . |
| 63-117109 | 5/1988 | Japan . |

*Primary Examiner*—Weilun Lo
*Attorney, Agent, or Firm*—Foley & Lardner

[57] ABSTRACT

A valve drive for an internal combustion engine, comprises a valve train which is operable in a first state to transfer the rotational motion of a low lift cam lobe to the reciprocating motion of a cylinder valve against a valve spring. The valve train is also operable in a second a sate to transfer the rotational motion of a high lift cam lobe to the reciprocating motion of the cylinder valve against the valve spring. The valve train includes a cam follower arranged to move between a first position in which the cam follower is driving relation with the low lift cam lode and a second position in which the cam follower is in driving relation with the high lift cam lobe. An actuator and a return mechanism are arranged outside of the valve train to shift the cam follower between the first and second positions thereof.

30 Claims, 19 Drawing Sheets

CYLINDER VALVE DRIVE FOR INTERNAL COMBUSTION ENGINE

BACKGROUND OF THE INVENTION

The present invention relates to a cylinder valve drive for internal combustion engines, JP-A 63-117109 discloses a cylinder valve drive for an internal combustion engine, A valve train is operable in a first state to transfer the rotational motion of a pair of low lift cam lobes of a camshaft to the reciprocating reciprocal motion of a pair of valve lifters for cylinder valves against valve springs. The valve train is also operable in a second state to transfer the rotational motion of a high lift cam lode, situated between the pair of low lift cam lobes, to the reciprocating motion of the pair of valve lifters against the valve springs. Specifically, a third lifter is arranged between the pair of valve lifters to follow the shape of the high lift cam lobe, and the pair of valve lifters carry hydraulic pistons or plungers. The third lifter is formed with bores adapted to mate with the plugere. In the second state, the plungers project into the mating bores of the Third lifter so that the pair of valve lifters follow the shape of the high lift cam lobe. According to this known valve drive, the plungers are carried by the valve lifters and the third lifter is arranged adjacent the valve lifters. Thus, the valve train requires valve springs of increased strength to bear increased inertia owing to the plungers carried by the valve lifters. Besides, the valve lifters and third lifter are complicated in structure, difficult to machine and thus not suitable for manufacture.

An object of the present invention is to provide a valve drive of the above kind which adds little increase in inertia to the valve train.

SUMMARY OF THE INVENTION

According to the present invention, there is provided a valve drive for an internal combustion engine. The valve drive comprises a cylinder valve having a stem, and a valve spring biasing the cylinder valve toward a closed position thereof. A camshaft is rotatable about an axis and carries a set of different cam lobes including a first cam lobe and a second cam lobe. A valve train is operable in a first state to transfer the rotational motion of the first cam lobe to a reciprocating motion of the cylinder valve against the valve spring. The valve train is also operable in a second state to transfer the rotational motion of the second cam lobe to a reciprocating motion of the cylinder valve against the valve spring. Means for shifting the valve train is provided between the first and second states.

The valve train includes a cam follower arranged to move between a first position in which the cam follower is in driving relation with the first cam lobe and a second position in which said cam follower is in driving relation with the second cam lobe. The shifting means shifts the cam follower between the first and second positions thereof.

DETAILED DESCRIPTION OF THE INVENTION

Referring to FIGS. 1 to 7, the first embodiment is described.

According to the first embodiment, the invention is embodied in a valve train including two cylinder valves, arranged for performing the same function per each of a plurality of cylinders of an internal combustion of the inline type or V-type engine. In this embodiment, the two cylinder valves are intake valves although they may be exhaust valves. The invention may be embodied in a valve train including a single cylinder valve for performing an intake or exhaust function per one cylinder.

Figure 2:
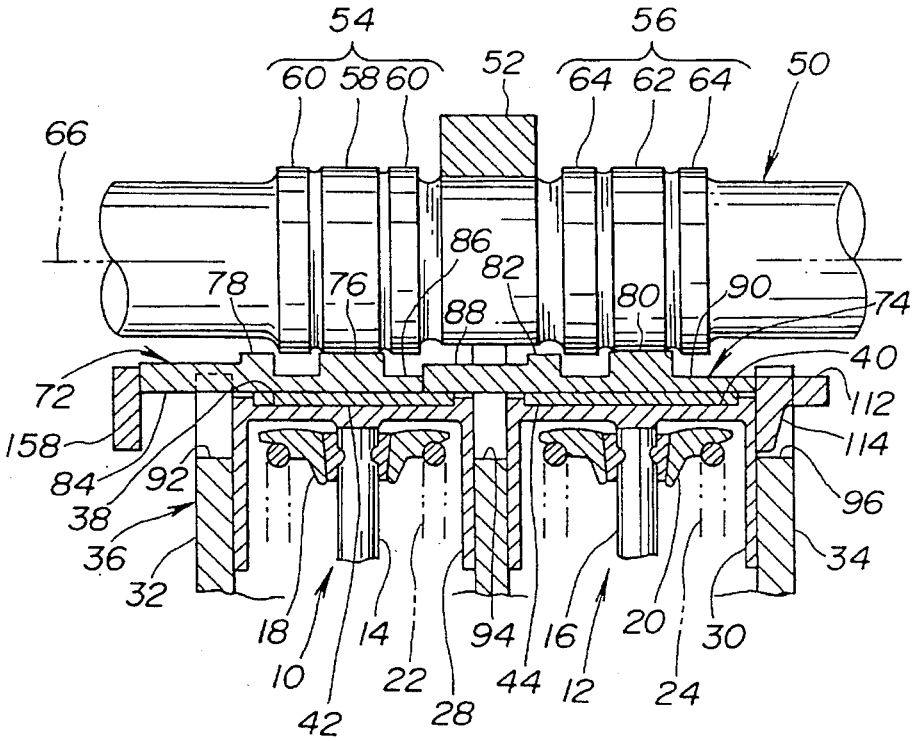
FIG. 2 is a cross-sectional view taken along the line 2—2 of FIG. 1 with the camshaft assembled.

As best seen in FIG. 2, the two cylinder valves, a first valve 10 and a second valve 12, are adjacent to each other. The first and second valves 10 and 12 have stems 14 and 16, respectively, which keep retainers 18 and 20 at portions adjacent ends thereof. A first valve spring 22 holds the first valve 10 against the seat (not shown) when the first valve 10 is not operated("unlifted"). A second valve spring 24 holds the second valve 12 against the seat (not shown), when the second valve 12 is not operated ("unlifted"). One end of the valve spring 22 is seated against the cylinder head 26 (see FIG. 3). The other end of the valve spring 22 is held under compression to the stem 14 through the retainer 18. One end of the valve spring 24 is seated against the cylinder head 26. The other end of the valve spring 24 is held under compression to the stem 16 through the retainer 20.

A first valve lifter 28 and a second valve lifter 30 are slidably arranged in valve lifter guides 32 and 34 of a valve lifter guide structure integral with the cylinder head 26, respectively, to impart a reciprocating motion to the first and second valves 10 and 12. The first and second valve lifters 28 and 30 are cylindrical in shape and have end surfaces, respectively, which are recessed to form pockets 38 and 40. The pockets 38 and 40 are surrounded by circular edges, respectively.

A first disc 42 snugly fits in the pocket 38 of the first valve lifter 28. A second disc 44 snugly fits in the pocket 40 of the second valve lifter 30. The first and second discs 42 and 44 are formed with diametrical guide grooves 46 and 48 (see FIG. 1). These guide grooves 46 and 48 are aligned along a line perpendicular to a direction in which the valve lifters 28 and 30 are thrusted during reciprocating motion by a camshaft 50 driven by a crankshaft of the engine.

Figure 5:
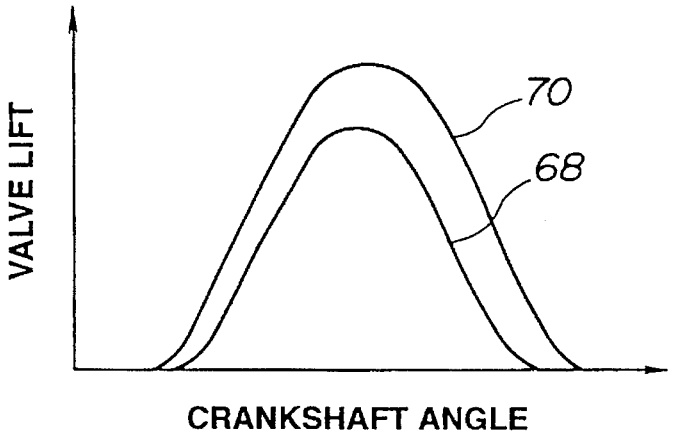
FIG. 5 shows valve lift diagrams of a low speed cam lode and a pair of high speed cam lobes of the camshaft.

The camshaft 50 is supported in part by a bearing 52 that is carried by the cylinder head 26 in known manner. The camshaft 50 carries a first set of cam lobes 54 mated with the first valve lifter 28 and a second set of cam lobes 56 mated with the second valve lifter 30. The first set of cam lobes 54 includes a low speed cam lobe 58 situated between a pair of axially spaced high speed cam lodes 60. The second set of cam lobes 56 includes a low speed cam lobe 62 situated between a pair of axially spaced high speed cam lobes 64. The arrangement is such that the camshaft 50 is rotatable about an axis 66 parallel to the line along which the guide grooves 46 and 48 are aligned and the low speed cam lobes 58 and 62 are disposed above the centers of the mated valve lifters 28 and 30, respectively. As shown in FIG. 5, the low speed cam lobes 58 and 62 exibit a valve lift characteristic curve 68 and the high speed cam lobes 60 and 64 exhibit a valve lift characteristic curve 70. As readily seen from FIG. 3, the outer periphery of the low speed cam lobe 58 is confined within the outer periphery of the high speed cam lobe 60. The axial width of each of the low speed cam lobes 58 and 62 is greater than that of any one of the adjacent pair of high speed cam lobes 60 or 64. From the preceding description, it will be understood that each set of cam lobes carried by the camshaft 50 has cam lobes with different lift characteristics, namely a low lift cam lobe and a high lift cam lobe.

Figure 1:
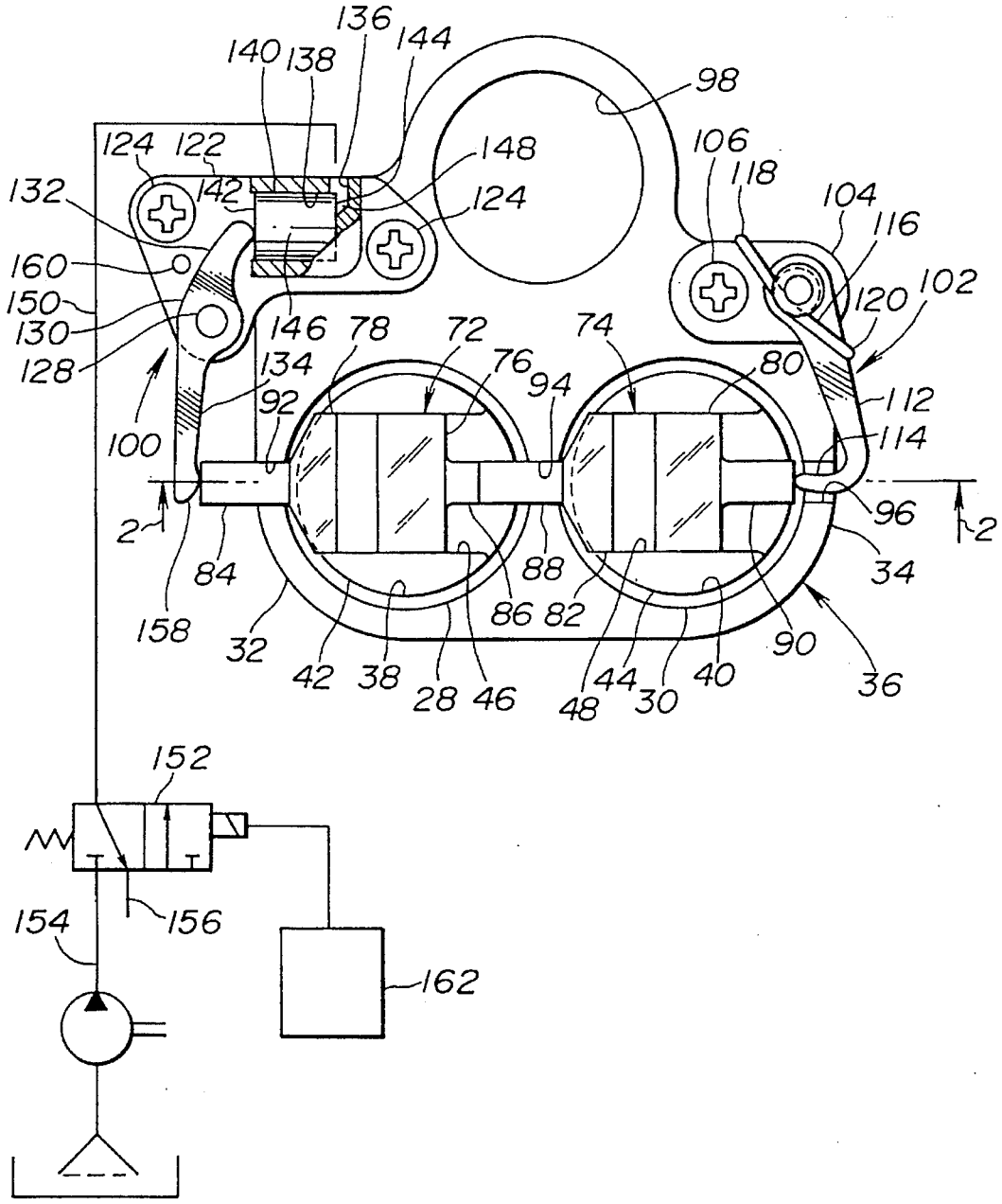
FIG. 1 is a plan view of a first embodiment of a valve drive according to the present invention with a camshaft removed, showing a train of cam followers at a first position thereof.
Figure 3:
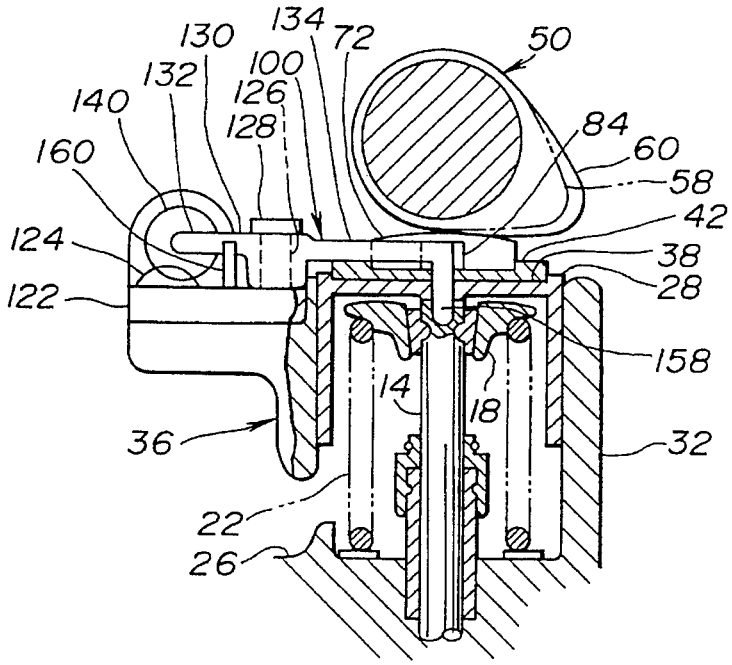
FIG. 3 is a side view of FIG. 1 taken from the lefthand side and partly sectioned to show the arrangement of the parts.

Referring to FIGS. 1 to 3, a first cam follower 72 is disposed between the camshaft 50 and valve lifter 28, while a second cam follower 74 is disposed between the camshaft 50 and second valve lifter 30. The first cam follower 72 is carried the first valve lifter 28, while the second cam follower 74 is carried by the second valve lifter 30. The first and second cam followers 72 and 74 are received in the guide grooves 46 and 48, respectively. The first cam follower 72 has two spaced lands, a main land 76 and an auxiliary land 78. The main land 76 has a top surface adapted to slide on the low speed cam lode 58 or one of the adjacent pair of high speed cam lodes 60. The auxiliary land 78 has a top surface adapted to slide on the other of the adjacent pair of high speed cam lodes 60. The second cam follower 74 has two spaced lands, a main land 80 and an auxiliary land 82. The main land 80 has a top surface adapted to slide on the low speed cam lobe 62 or one of the adjacent pair of high speed cam lobes 64. The auxiliary land 82 has a top surface adapted to slide on the other of the adjacent pair of high speed cam lobes 64.

The top surface of each of the main lands 76 and 80 is bounded by two straight sides spaced along the line parallel to the axis 66 of the camshaft 50 and two parallel sides spaced perpendicularly to the line parallel to the axis 66 of the camshaft 50 and interconnecting the two straight sides. The top surface of each of the auxiliary lands 78 and 82 is bounded by two straight sides spaced along the line parallel to the axis 66 of the camshaft 50. These two straight sides consist of a straight side spaced from and opposed to the adjacent side of the adjacent main land 76 or 80 and a shorter straight side adjacent the bore defining wall of the adjacent one of the valve lifter guides 32 and 34. The top surface of each auxiliary land 78 or 82 is bounded also by two parallel sides spaced perpendicularly to the line parallel to the axis 66 of the camshaft 50 and two angled sides. One of the two angled sides is connected between the shorter straight side and one of the two parallel sides spaced perpendicularly to the line parallel to the axis 66 of the camshaft 50, and the other is connected between the shorter straight side and the other of the two parallel sides spaced perpendicularly to the line parallel to the axis 66 of the camshaft 50.

The first cam follower 72 has an integral rod 84 projecting from the auxiliary land 78 and an integral rod 86 projecting from the main land 76. The second cam follower 74 has an integral rod 88 projecting from the auxiliary land 82 and an integral rod 88 projecting from the main land 90. As best seen in FIG. 1, the rods 84, 86, 88 and 90 are aligned along the line parallel to the axis 66 of the camshaft 50. The valve lifter guides 32 and 34 are formed with three U-shaped cuts 92, 94 and 96 which are spaced along the line parallel to the axis 66 of the camshaft 50. The U-shaped cut 92 allows the passage of the rod 84, U-shaped cut 94 allows the passage of the rod 88, and U-shaped cut 96 allows the passage of the rod 90 (see FIGS. 2 and 7). The U-shaped cuts 92, 94 and 96 are deep enough to avoid interference of the rods 84, 88 and 90 with the valve lifter guides 32 and 34 during reciprocating motion of the cam followers 72 and 74 together with the valve lifters 28 and 30.

Figure 6:
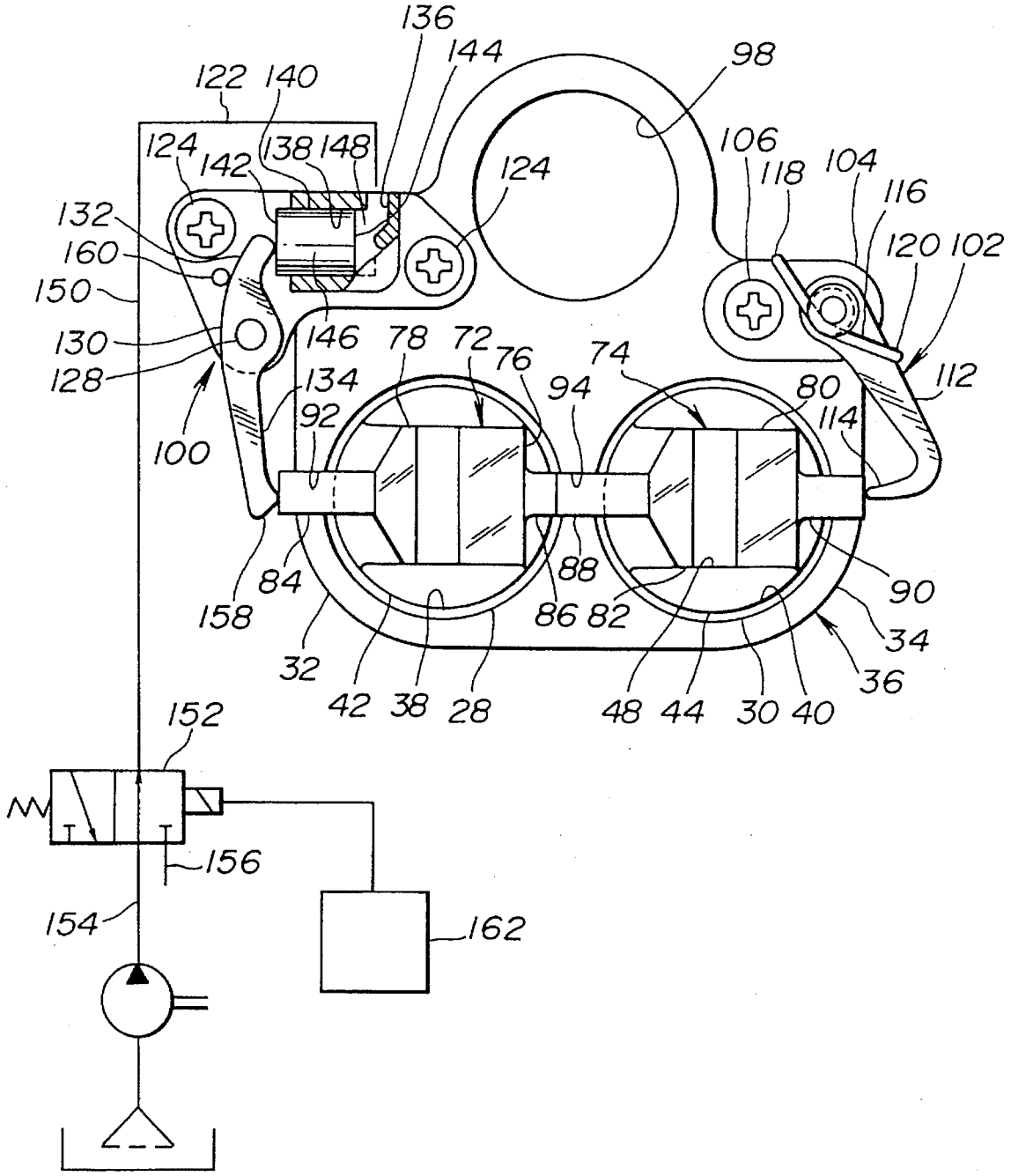
FIGS. 6 and 7 are views similar views to FIGS. 1 and 2, but showing the position of parts when the train of cam followers is at a second position thereof after shifting means has been urged to shift the train of cam followers from the first position thereof to the second position thereof.
Figure 7:
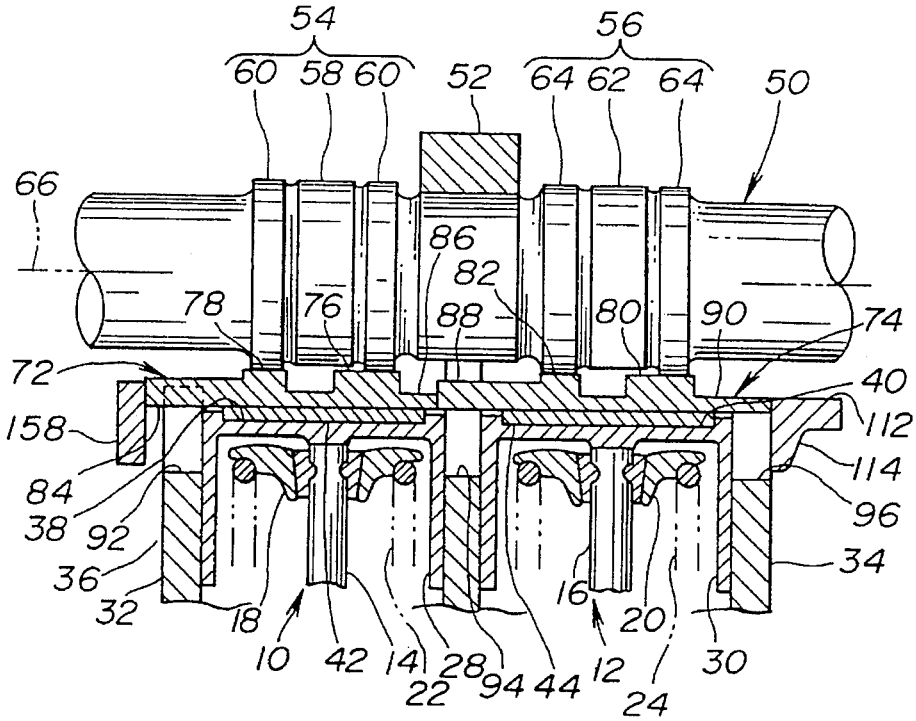

The cam followers 72 and 74 are slidably received by the discs 42 and 44 for movement along the line parallel to the axis 66 of the camshaft 50. The rods 86 and 88 are kept in abutting engagement with one after another to form a cam follower train or assembly. The train of cam followers 72 and 74 has a first position as illustrated in FIGS. 1 and 2, and a second position as illustrated in FIGS. 6 and 7. In the first position (see FIG. 2), the main lands 76 and 80 are in driving relation with the low speed cam lobes 58 and 62, respectively, while the auxiliary lands 78 and 82 are out of driving relation with the adjacent high speed cam lobes 60 and 64, respectively. In the second position (see FIG. 7), the main lands 76 and 80 are out of driving relation with the low speed cam lobes 58 and 62, respectively, and the main and auxiliary lands 76 and 78 of the first cam follower 72 are in driving relation with the pair of high speed cam lodes 60, respectively, and the main and auxiliary lands 80 and 82 of the second cam follower 74 are in driving relation with the pair of high speed cam lobes 64, respectively.

In the first position as illustrated in FIGS. 1 and 2, the valve lifters 28 and 30 follow the shape of the low speed cam lobes 58 and 82 so that the valve lifters 28 and 30 are lifted against the valve springs 22 and 24 during each turn of the camshaft 50. In the second position as illustrated in FIGS. 6 and 7, the valve lifters 28 and 30 follow the shape of the high speed cam lobes 60 and 64.

Referring back to FIG. 1, the valve lifter guide structure 36 is formed with a spark plug hole 98. The valve lifter guide structure 36 has mounted thereon an actuator 100 adjacent the rod 84 of the train of cam followers 72 and 74, and a return mechanism 102 adjacent the rod 90 of the train of cam followers 72 and 74. The train of cam followers 72 and 74 is shiftable from the first position (see FIGS. 1 and 2) to the second position (see FIGS. 6 and 7) and vice versa by the actuator 100 and return mechanism 102.

Figure 4:
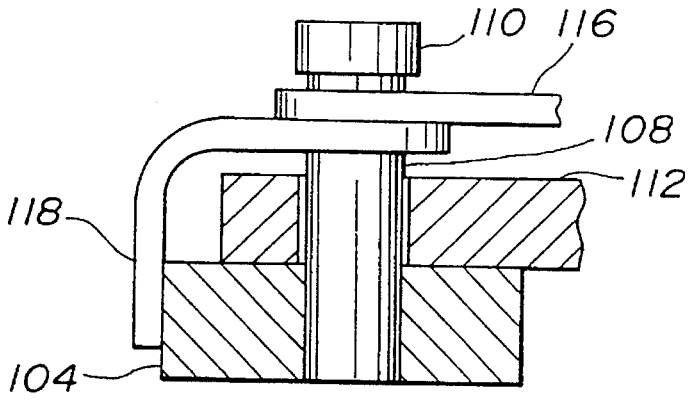
FIG. 4 is an enlarged diagrammatic view showing how a torsion spring is mounted around a short rod to impart torque to a return lever shown in FIG. 1.

The return mechanism 102 includes a support 104 attached to the valve lifter guide structure 36 by a fastner 106. As best seen in FIG. 4, a short rod 108 has one end portion fixed to the support 104 and carries a head 110 at the other end. A return arm 112 is supported by the short rod 108 for rotation thereabout. The return arm 112 projects from the short rod 108 and terminates in an insert 114 disposed in the U-shaped cut 96. Within the U-shaped cut 96, the insert 114 extends between the top opening of the U to the bottom of the U to maintain contact with the rod 90 during reciprocal motion the valve lifter 30 (see FIG. 2). A torsion spring 116 is carried by the short rod 108 and disposed between the return arm 112 and head 110. One end of the torsion spring 118 is anchored to the peripheral side of the support 104 and the other end 120 thereof anchored to the return arm 112. Viewing in FIG. 1, the torsion spring 116 imparts a clockwise torque to the return arm 112, biasing the train of cam followers 72 and 74 in the lefthand direction through the insert 114 kept in contact with the rod 66 of the cam follower 74.

The actuator 100 is of the hydraulic type in this embodiment although it may be of the electro-magnetic type, if desired. The actuator includes a support 122 attached to the valve lifter guide structure 36 by a plurality of fastners 124. The support 122 has a short rod 126. The short rod 126 is fixed to the support 122 at one end and carries a head 128 at the other end (see FIG. 3). A lever 130 is rotatably supported by the short rod 126. The short rod 126 serves as the fulcrum of the lever 130. The lever 130 includes an inner arm 132 projecting inwardly of the support 122 and an outer arm 134 projecting outwardly from the support 122 towards the rod 84 of the train of cam followers 72 and 74. The support 122 is formed with a port 136 and a blind ended bore 138 communicating with the port 136 through an aperture of the closed end of the core 138. A piston 140 is received in the bore 138 for motion along a line parallel to the axis 66 of the camshaft 50. The piston 140 has two spaced parallel end walls, an outer end wall 142 and an inner end wall 144, which are spaced and interconnected by a cylindrical peripheral wall 146. The piston 140 defines a variable volume hydraulic chamber 148 (see FIG. 6) within the bore 138 between the inner end wall 144 and the closed end of the bore 138. This chamber 148 is in constant communication with the hydraulic port 136. The port 136 is connected through a schematically illustrated passage means 150 with a solenoid control valve 152 which operates to supply oil from an oil gallery 154 or to drain oil to a discharge line 156 while blocking the flow from the gallery 154.

The inner arm 132 is arranged to slidably abut on the outer end wall 142 of the piston 140 to follow the motion thereof. The outer arm 134 has a leading end formed with an integral finger 158. The finger 158 is arranged to slidably abut on the adjacent end of the rod 84 of the train of cam followers 72 and 74. As shown in FIG. 2, the finger 158 is long enough to maintain contact with the rod 84 during reciprocating motion of valve lifters 28 and 30. A stop pin 160 is affixed to the support 122 and arranged to abut on the inner arm 132 to limit counterclockwise motion of the lever 130 beyond the position shown in FIG. 6. The solenoid control valve 152 is under the control of an engine control unit 162.

In operation of the first embodiment just described, when the solenoid control valve 152 is not energized, the solenoid control valve 152 closes off the oil gallery 154 and opens the hydraulic chamber 148 to the discharge line 156. The torsion spring 116 is able to maintain the train of cam followers 72 and 74 in the first position thereof as illustrated in FIGS. 1 and 2. In this first position, the valve lifters 28 and 30 are unlifted against the valve springs 22 and 24 by the low speed cam lobes 58 and 62 through the main lands 76 and 80 and discs 42 and 44.

When the engine operating conditions call for advanced valve opening timing of intake valves, the solenoid control valve 152 is energized to close off the discharge line 156 and to open the oil gallery 154 to supply oil under pressure to the hydraulic chamber 148. When the valve lifters 28 and 30 are unlifted so that the cam followers 28 and 30 are not affected by the valve springs 22 and 24, the oil pressure in the hydraulic chamber 148 moves the piston 140 out of the bore 138, turning the lever 130 counterclockwise, as viewed in FIG. 1, causing the finger 158 of the outer arm 134 to move the train of cam followers 72 and 74 against the bias of the torsion spring 116 to the second position as illustrated in FIGS. 6 and 7. Further movement of the train of cam followers 72 and 74 beyond this second position is limited by abutting engagement of the stop pin 160 with the inner arm 132 of the lever 130. When the valve lifters 28 and 30 are lifted, this movement of the train of cam followers 72 and 74 is prevented owing to the bias of the valve springs 22 and 24. In the second position (see FIG. 7), the valve lifters 28 and 30 are lifted by the pairs of high speed cam lobes 60 and 64.

A return to the retarded opening timing of the intake valves when called for is accomplished by de-energizing the solenoid control valve 152 blocking oil from the oil gallery 154 and allowing the hydraulic chamber 148 to drain to the discharge line 156. When the valve lifters 28 and 2.0 are unlifted and the cam followers 72 and 74 are not subjected to the bias of the valve springs 22 and 24, the return arm 112 turns counterclockwise, viewing in FIG. 6, owing to the torsion spring 116, causing the insert 114 to move the train of cam followers 72 and 74 to the first position as illustrated in FIGS. 1 and 2. Owing to this movement of the train of cam followers 72 and 74, the lever 130 and the piston 140 return to their initial positions as illustrated in FIGS. 1 and 2. When the valve lifters 28 and 30 are lifted, this movement of the train of cam followers 72 and 74 is prevented owing to the bias of the valve springs 22 and 24.

Figure 8:
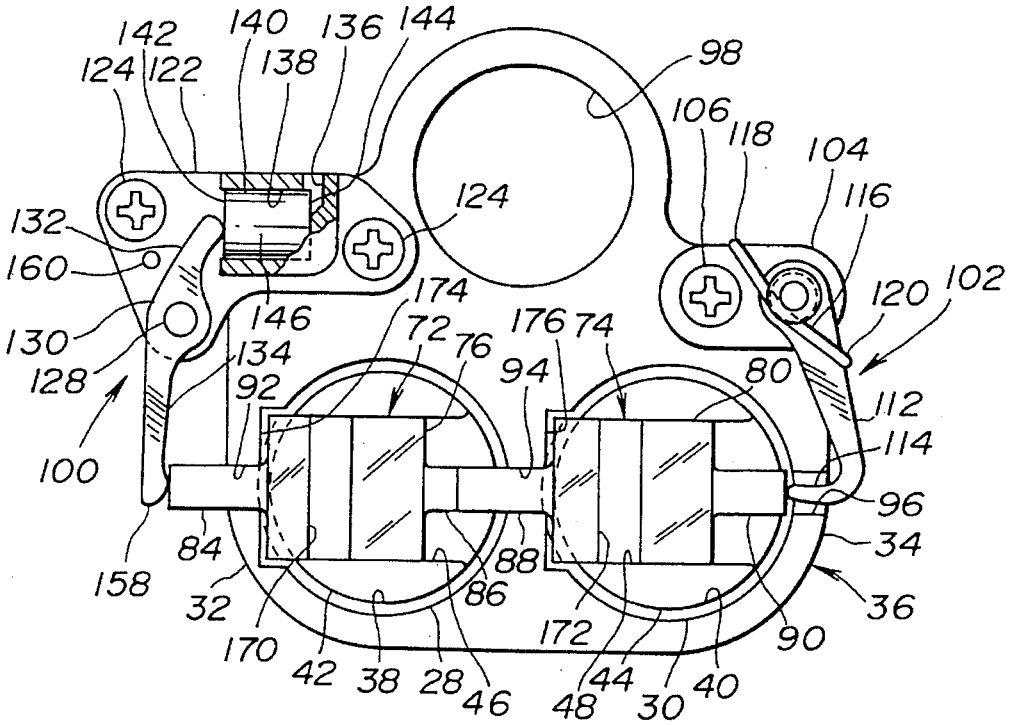
FIG. 8 shows a second embodiment of the valve drive similar to FIG. 1.

Referring to FIG. 8, the second embodiment is substantially the same as the first embodiment. This second embodiment is different from the first embodiment in that cam followers 72 and 74 have modified auxiliary lands 170 and 172 and valve lifter guides 34 and 36 are formed with recesses 174 and 176 receiving the modified auxiliary lands 170 and 172, to avoid interference between the valve lifter guides 32 and 34 and the modified auxiliary lands 170 and 172 during reciprocal motion of valve lifters 28 and 30. Comparing FIG. 8 with FIG. 1, it is readily seen that the auxiliary lands 170 and 172 has a rectangular face with increased area. With this arrangement, the width of the auxiliary lands 170 arid 172 may be increased, if desired. The use of the auxiliary lands 170 and 172 with increased width is advantageous in decreasing rate of wear of the mated high speed cam lobes 60 and 64.

Figure 9:
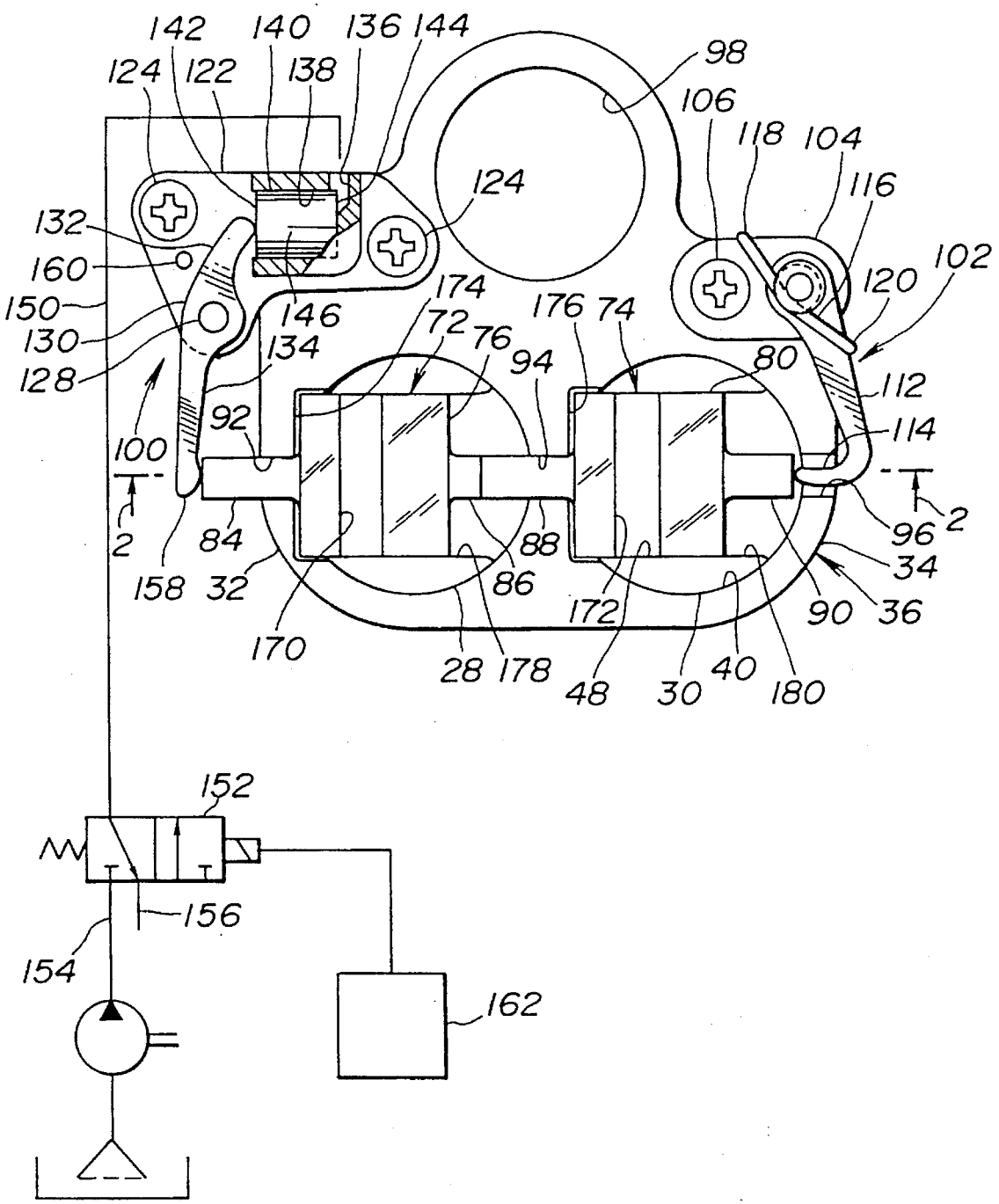
FIGS. 9, 10 and 11 show a third embodiment of the valve drive similar to FIGS. 1, 2 and 3, respectively.
Figure 10:
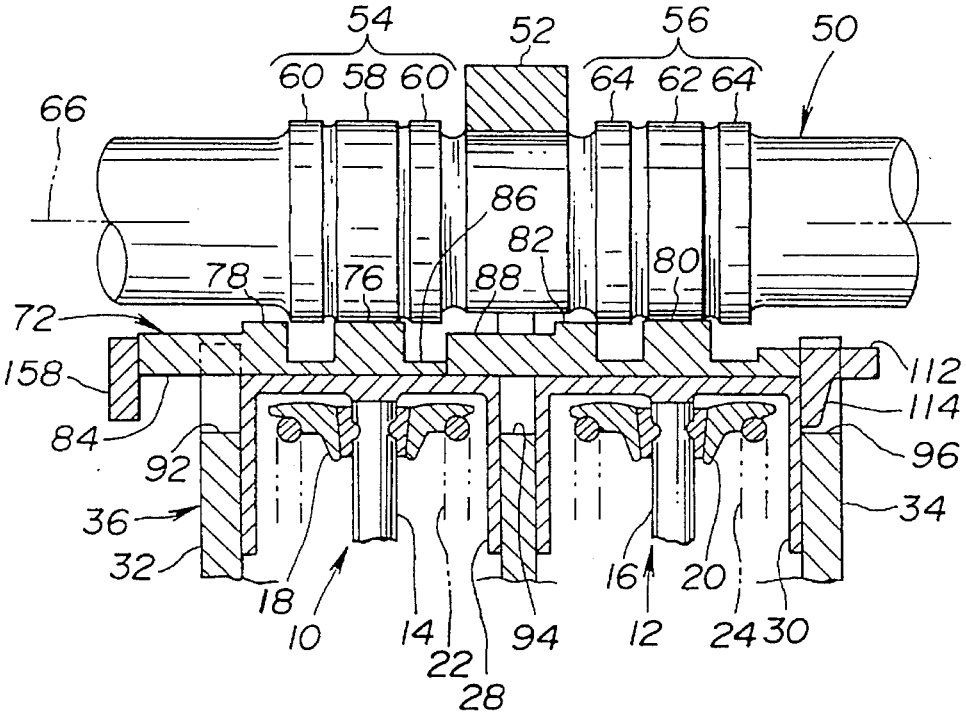
Figure 11:
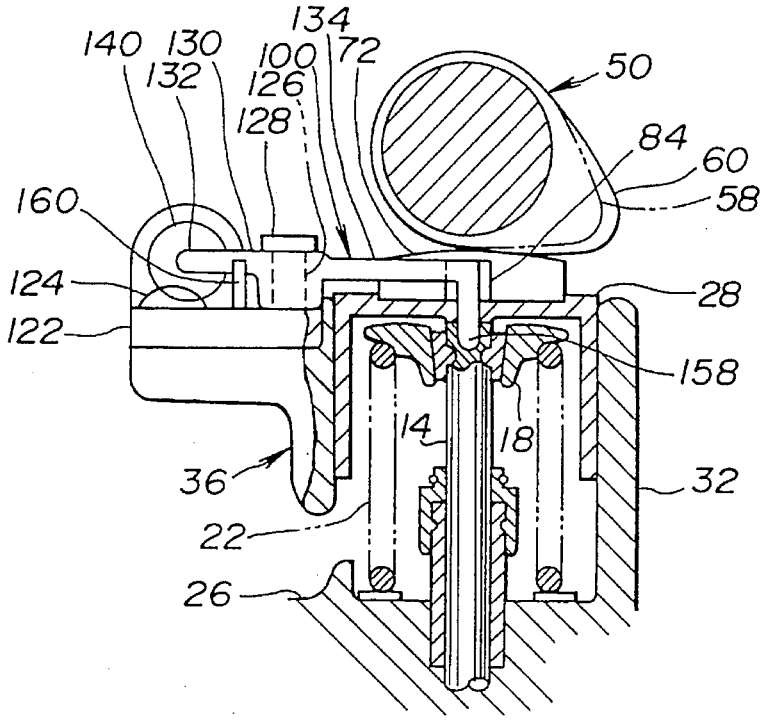

Referring to FIGS. 9, 10 and 11, the third embodiment is substantially the same as the second embodiment. However, this third embodiment is different from the second embodiment in the manner of supporting cam followers 72 and 74 by valve lifters 28 and 30. Specifically, the discs 42 and 44 used in the first and second embodiments are not used and the valve lifters 28 and 30 are not formed with the pockets 38 and 40. Instead, the valve lifters 28 and 30 are formed with diameterical guide grooves 178 and 180 which are aligned along a line perpendicular to a direction in which the valve lifters 28 and 30 are thrusted during reciprocating motion by a camshaft 50. The guide grooves 178 and 180 slidably receive the cam followers 72 and 74, respectively. According to this support structure, the height between the point at which the cam follower 72 or 74 is contacted by the cam lode of the camshaft 50 and the bottom wall of the mated guide groove 178 or 180 may be maximized. This is convenient if it is desired to use low and high speed cam lobes with a great cam lift difference.

Referring to FIGS. 12 to 20, the fourth embodiment is described. This fourth embodiment is substantially the same as the first embodiment. However, this fourth embodiment is different from the first embodiment in the provision of a mechanism for restraining an undesired shift of a train of cam followers 72 and 74 when valve lifters 28 and 30 are unlifted.

Figure 12:
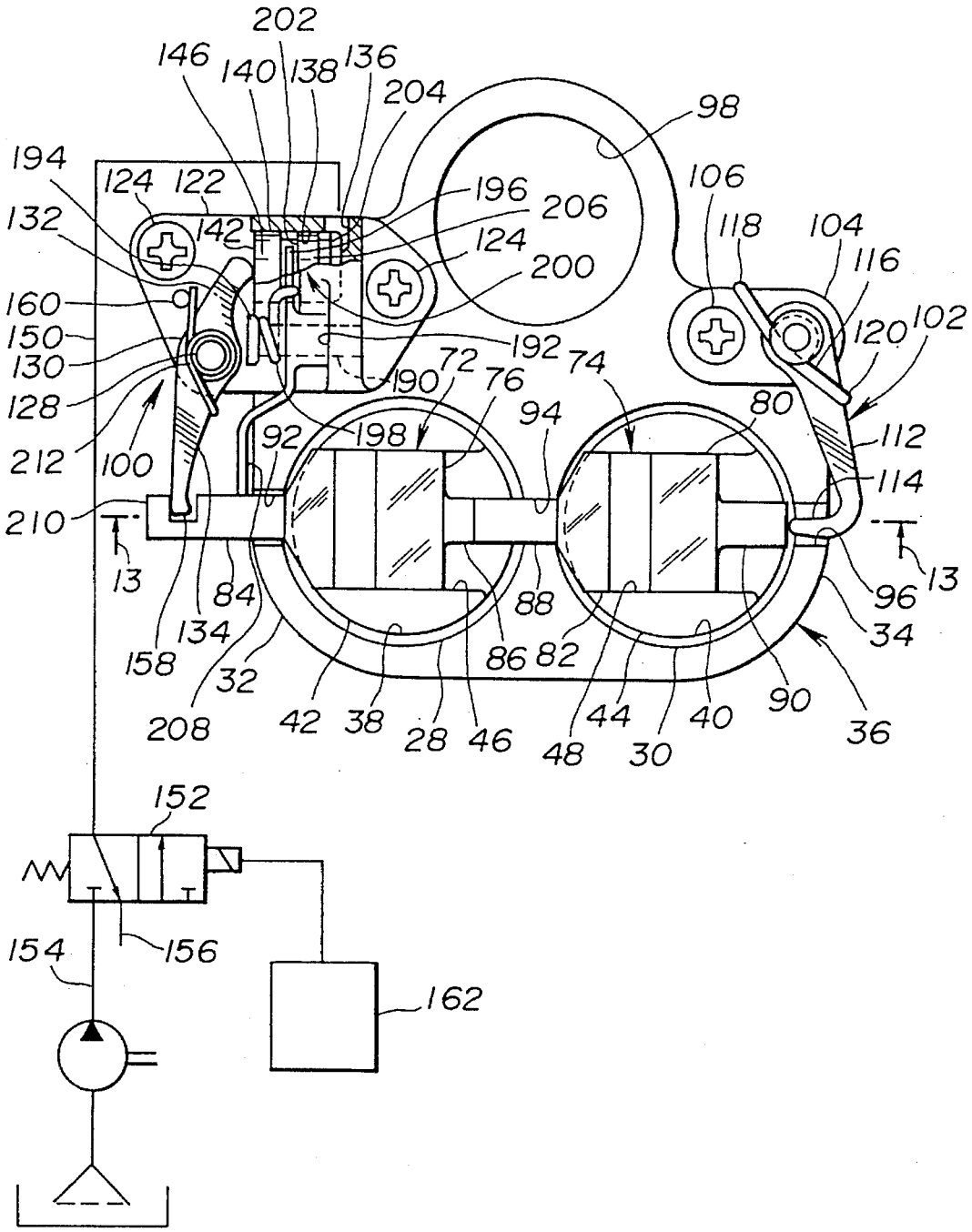
FIG. 12 a shows fourth embodiment of the valve drive with a camshaft removed, showing a train of cam followers at a first position thereof.
Figure 14:
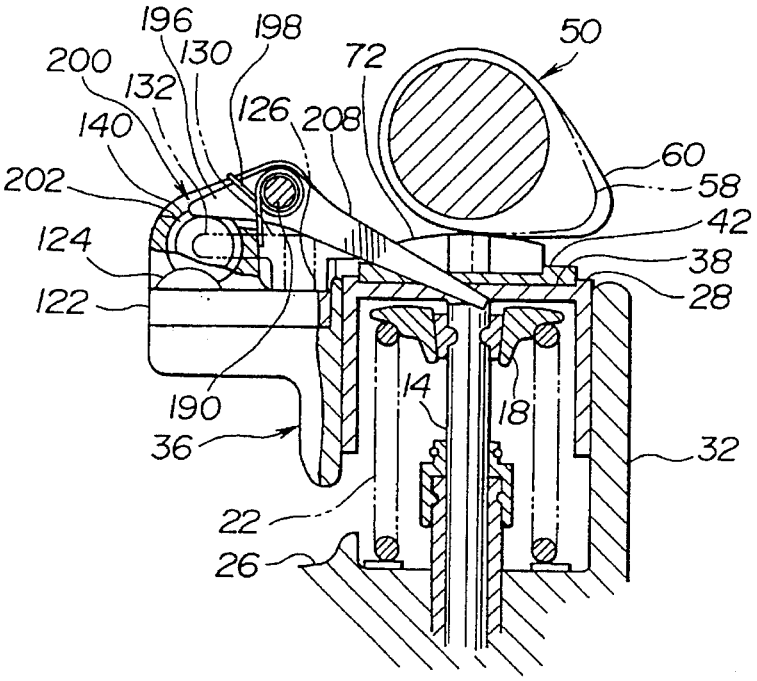
FIG. 14 is a side view of FIG. 12 taken from the lefthand side and partly sectioned to show the arrangement of the parts.
Figure 15:
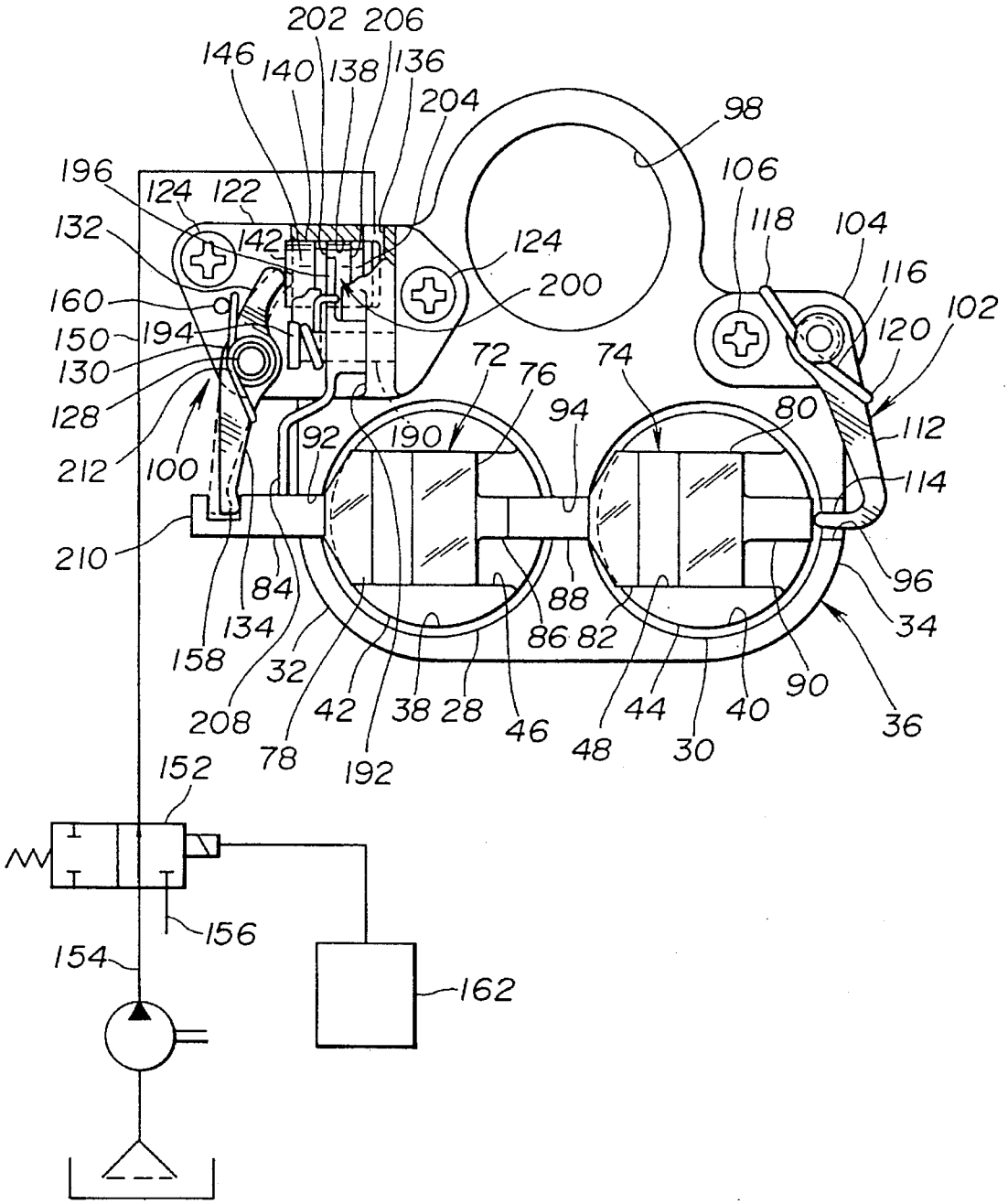
FIGS. 15, 16 and 17 are views similar to FIGS. 12, 13 and 14, respectively, and show the position of the parts when the valve the lifters are about to enter "unlifted" phase after shifting means has been urged to shift the train of cam followers from the first position thereof to the second position thereof so that the train of cam followers is ready to move to the second position thereof upon the valve lifters entering the "unlifted" phase.

Referring to FIGS. 12 and 14, a support 122 of an actuator 100 has a short rod 190 adjacent a piston 140. The short rod 190 has one end fixed to a standing wall 192 of the support 122 and lies in parallel to an axis 66 of a camshaft 50. At the opposite end, the short rod 190 carries a head 194. Supported by the short rod 190 is a restraining arm 196. The arm 196 is rotatable about an axis, extending through the center of the short rod 190, parallel to the axis 66 of the camshaft 50. A torsion spring 198 is carried by the short rod 190 and disposed between the head 194 and arm 196. As best seen in FIG. 14, one end of the torsion spring 198 bears against the adjacent vertical wall and the other end thereof is anchored to the arm 196 to bias the arm 196 to an armrest 200 with which a piston 140 is formed. The armrest 200 includes an axially spaced two radial faces, a first or outer face 202 and a second or inner face 204, and a portion 206 of a cylindrical peripheral wall 146 of the piston 140 defined between the outer and inner faces 202 and 204. A handle 208 integral with the arm 196 extends into the path of reciprocal motion of a rod 84 of a train of cam followers 72 and 74.

The rod 84 has an integral stop 210 cooperating with an integral finger 158 of an outer arm 134 of a lever 130. As is seen from FIG. 12, a torsion spring 212 is carried by a short rod 126 and disposed between a head 128 and the lever 130. One end of the torsion spring 212 bears against a stop pin 160 and the other end of the torsion spring 212 is anchored to the outer arm 134 thereby to bias the finger 158 of the outer arm 134 to the integral stop 210 of the rod 84 and an inner arm 132 of the lever 130 to an outer end wall 142 of the piston 140. The finger 158 of the outer arm 134 is spaced from the rod 84 to provide a lost motion connection between the piston 140 and the train of cam followers 72 and 74.

Figure 13:
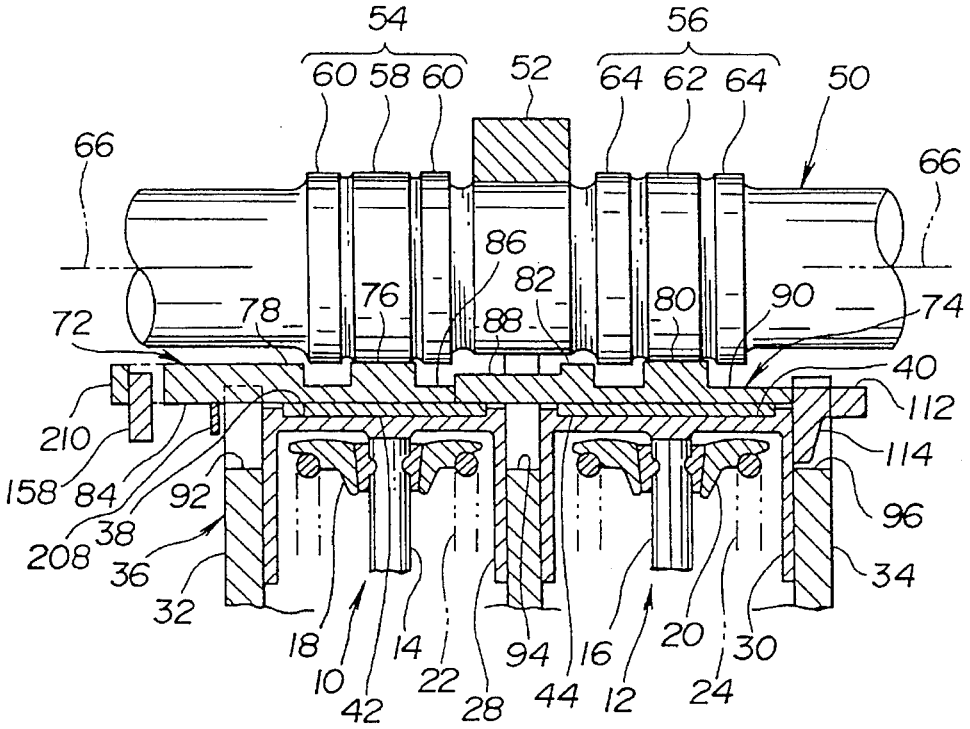
FIG. 13 is a cross-section view taken along the line 13—13 of FIG. 12 with the camshaft assembled.

In operation of the fourth embodiment just described, when a solenoid control valve 152 is not energized, the solenoid control valve 152 closes off an oil gallery 154 and opens a hydraulic chamber 148 of the piston 140 to a discharge line 156. A torsion spring 116 of a return mechanism 102 is able to maintain the train of cam followers 72 and 74 in a first position thereof as illustrated in FIGS. 12 and 13. In the first position, main lands 76 and 80 are in driving relation with low speed cam lobes 58 and 62 (see FIG. 13). The finger 158 of the outer arm 134 of the lever 212 is biased to the integral stop 210 due to the torsion spring 212. When the valve lifters 28 and 30 are unlifted, the torsion spring 198 biases the arm 196 to the piston 140 and the handle 208 to the rod 84. The arm 196 is opposed to the outer face 202 of the armrest 200 (see FIGS. 12 and 14) and the handle 208 abuts on the lower portion of the rod 84. Subsequently, when the valve lifters 28 and 30 are lifted, the rod 84 pushes the handle 208 down, as viewed from FIGS. 13 and 14, causing the arm 196 to turn clockwise, viewing in FIG. 14, against the bias of the torsion spring 198, separating or disengaging the arm 196 from the armrest 200. When the valve lifters 28 and 30 are unlifted again, the arm 196 is brought into opposed relation with the outer face 202 of the armrest 200.

Let us now assume that the solenoid control valve 152 is energized to close off the discharge line 156 and to open the oil gallery 154 to supply oil under pressure to the hydraulic chamber 148 when the arm 196 is in opposed relation with the outer face 202 of the armrest 200 with the valve lifters 28 and 30 unlifted. The oil pressure in the hydraulic chamber 148 urges the piston 140 to move out of the bore 138. Thus, the piston 140 tends to move out of the bore 138. However, this tendency of the piston 140 to move out of the bore 138 is restrained by engagement of the arm 196 with the outer face 202 of the armrest 200. Thus, the train of cam followers 72 and 74 remains in the first position thereof.

As the low speed cam lobes 58 and 62 begin to lift the valve lifters 28 and 30 against the valve springs 22 and 24, the rod 84 moves the handle 208 down to cause the arm 196 to disengage from the outer face 202 of the armrest 200, allowing movement of the piston 140 in response to the oil pressure in the hydraulic chamber 148. This movement of the piston 140 causes displacement of the armrest 200 relative to the arm 196 and causes the lever 130 to turn counterclockwise, against the bias of the torsion spring 212 until the integral finger 158 comes into abutting engagement with the end of the rod 84 as illustrated by the fully drawn line in FIG. 15. Since the train of cam followers 72 and 74 is biased by the valve springs 22 and 24 against the low speed cam lobes 58 and 62 and stays immobile from the first position thereof, turning of the lever 130 is limited by abutting engagement of the finger 158 with the end of the rod 84. This results in limiting the movement of the piston 140 and displacement of the armrest 200 relative to the arm 196 (see FIG. 15).

Figure 16:
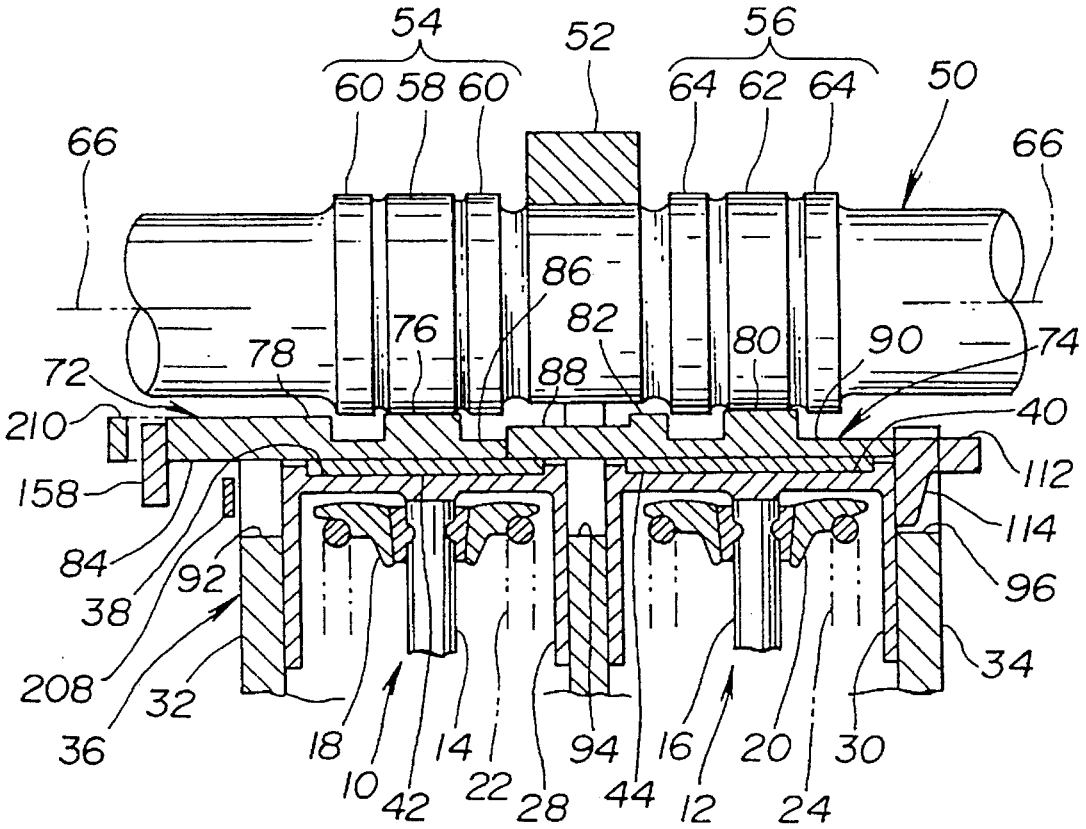
Figure 17:
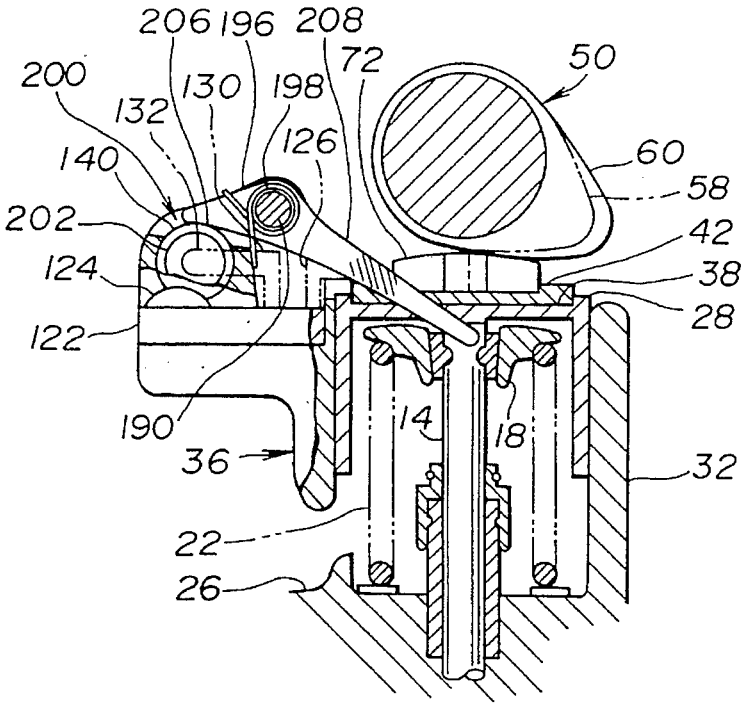

Immediately before the moment when the valve lifters 28 and 30 are unlifted again, the arm 196 rests on the armrest 200 out of opposed relation with the outer face 202 as illustrated in FIG. 17, and the handle 208 is left separated from the rod 84 (see FIGS. 16 and 17). The arm 196 is biased into engagement with the armrest 200 due to the torsion spring 198. However, the engagement of the arm 196 with the armrest 200 does not hamper movement of the piston 140.

At or immediately after the valve lifters 28 and 30 are unlifted again, the train of cam followers 72 and 74 is rendered mobile from the first position thereof, allowing the piston 140 to move further out of the bore 138 due to the oil pressure in the hydraulic chamber 148. This allows turning of the lever 130, causing the finger 158 to move the train of cam followers 72 and 74, against the bias of a torsion spring 116 of a return mechanism 102, to a second position thereof (see FIGS. 18 and 19). Further movement of the train of cam followers 72 and 74 beyond this second position is limited by abutting engagement of the inner arm 132 with a stop pin 160. During this movement, the arm 196 slides on the armrest 200 until it is brought into opposed relation with the inner face 204 of the armrest 200. As the arm 196 is brought into opposed relation with the inner face 204, the handle 208 turns to come into engagement with the lower portion of the rod 84. In the second position, main and auxiliary lands 76 and 78 of the cam follower 72 are in driving relation with a pair of high speed cam lobes 60, respectively, and the main and auxiliary lands 80 and 82 of the cam follower 74 are in driving relation with a pair of high speed cam lobes 64, respectively (see FIG. 19).

Next, let us assume that the solenoid control valve 152 is de-energized when the train of cam followers 72 and 74 is in the second position thereof and the arm 196 is in opposed relation with the inner face 204 of the armrest 200 with the valve lifters 28 and 30 unlifted. The hydraulic chamber 148 is opened to the discharge line 156. The piston 140 is held in a position to hold the inner arm 132 of the lever 130 against the stop pin 160 due to engagement of the arm 196 with the inner face 204 of the armrest 200. Thus, even under the bias of the torsion spring 116 of the return mechanism 102, the train of cam followers 72 and 74 remains in the second position thereof.

Figure 18:
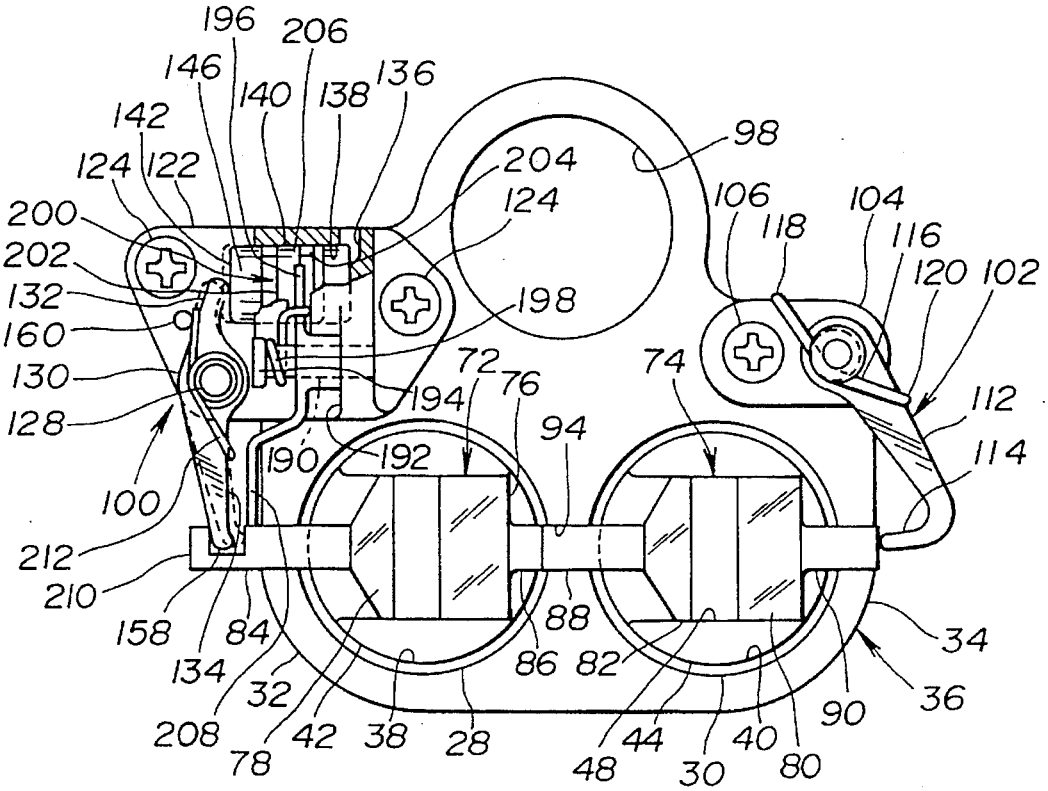
FIGS. 18, 19 and 20 are views similar to FIGS. 12, 13 and 14, respectively, and show the position of the parts when the valve lifters are about to enter "unlifted" phase after shifting means has been urged to shift the train of cam followers from the second position thereof back to the first position thereof so that the train of cam followers is ready to move back to the first position thereof upon the valve lifters entering the "unlifted" phase.

As the high speed cam lobes 60 and 64 begin to lift the valve lifters 28 and 30 against the valve springs 22 and 24, the rod 84 moves the handle 208 30 down, causing the arm 196 to disengage from the inner face 204 of the armrest 200, rendering the piston 140 mobile, allowing the torsion spring 212 to turn the lever 130 clockwise, as viewed from FIG. 18, to cause the inner arm 132 to move the piston 140 into the bore 138. This movement of the piston 140 causes displacement of the armrest 200 relative to the arm 196 until the integral finger 158 comes into abutting engagement with the integral stop 210 of the rod 84 as illustrated by the fully drawn line in FIG. 18. Since the train of cam followers 72 and 74 stays immobile from the second position thereof due to the valve springs 22 and 24, turning of the lever 130 is limited by abutting engagement of the finger 158 with the integral stop 210 of the rod 84.

Figure 19:
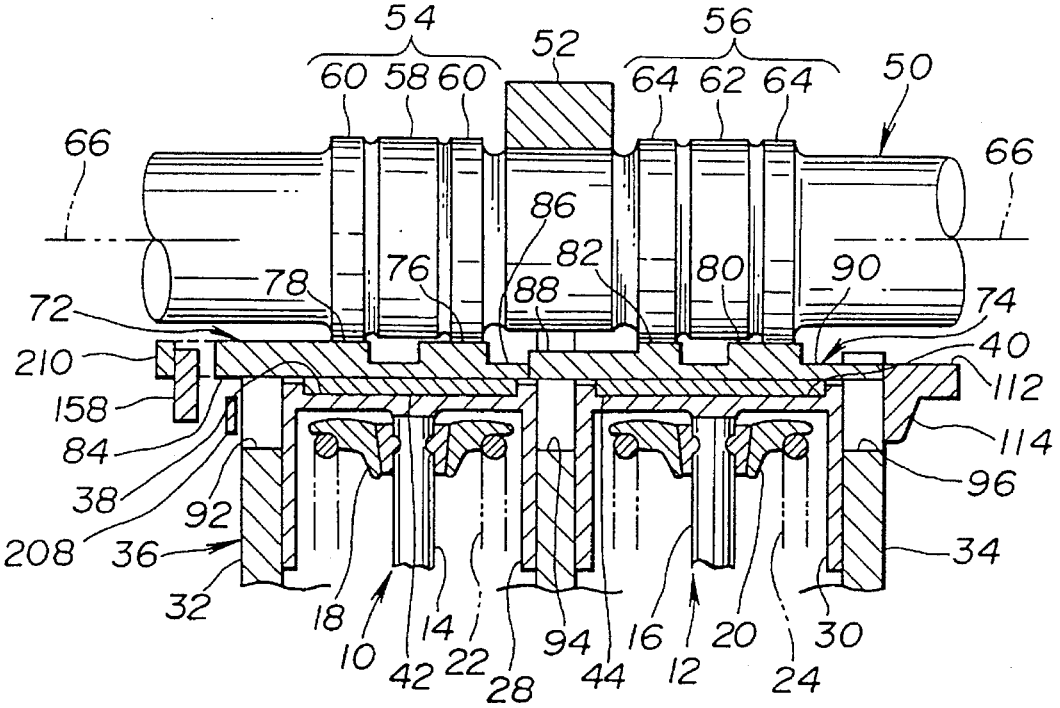
Figure 20:
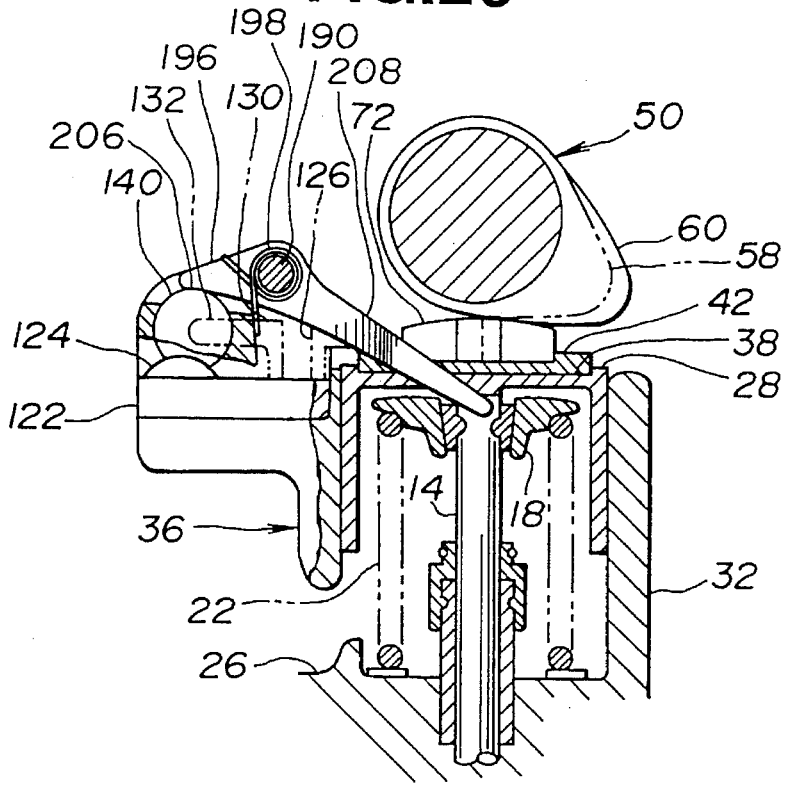

Immediately before the moment when the valve lifters 28 and 30 are unlifted again, the arm 196 rests on the armrest 200 out of opposed relation with the inner face 204 as illustrated in FIG. 18, and the handle 208 is left separated from :he rod 84 (see FIGS. 19 and 20). The arm 196 is biased into engagement with the armrest 200 due to the torsion spring 198. However, this engagement of the arm 196 with the armrest 200 does not hamper movement of the piston 140.

At or immediately after the valve lifters 28 and 30 are unlifted again, the train of cam followers 72 and 74 is rendered mobile from the second position thereof, allowing the torsion spring 116 to move the train of cam followers 72 and 74 from the second position thereof to the first position thereof (see FIG. 12). During this movement of the train of cam followers 72 and 74, the torsion spring 212 turns the lever 130 clockwise from the position illustrated in FIG. 18 to the position illustrated in FIG. 12, moving the piston 140 from the position illustrated in FIG. 18 to the position illustrated in FIG. 12, bringing the arm 196 into opposed relation with the outer face 202 of the armrest 200.

Figure 21:
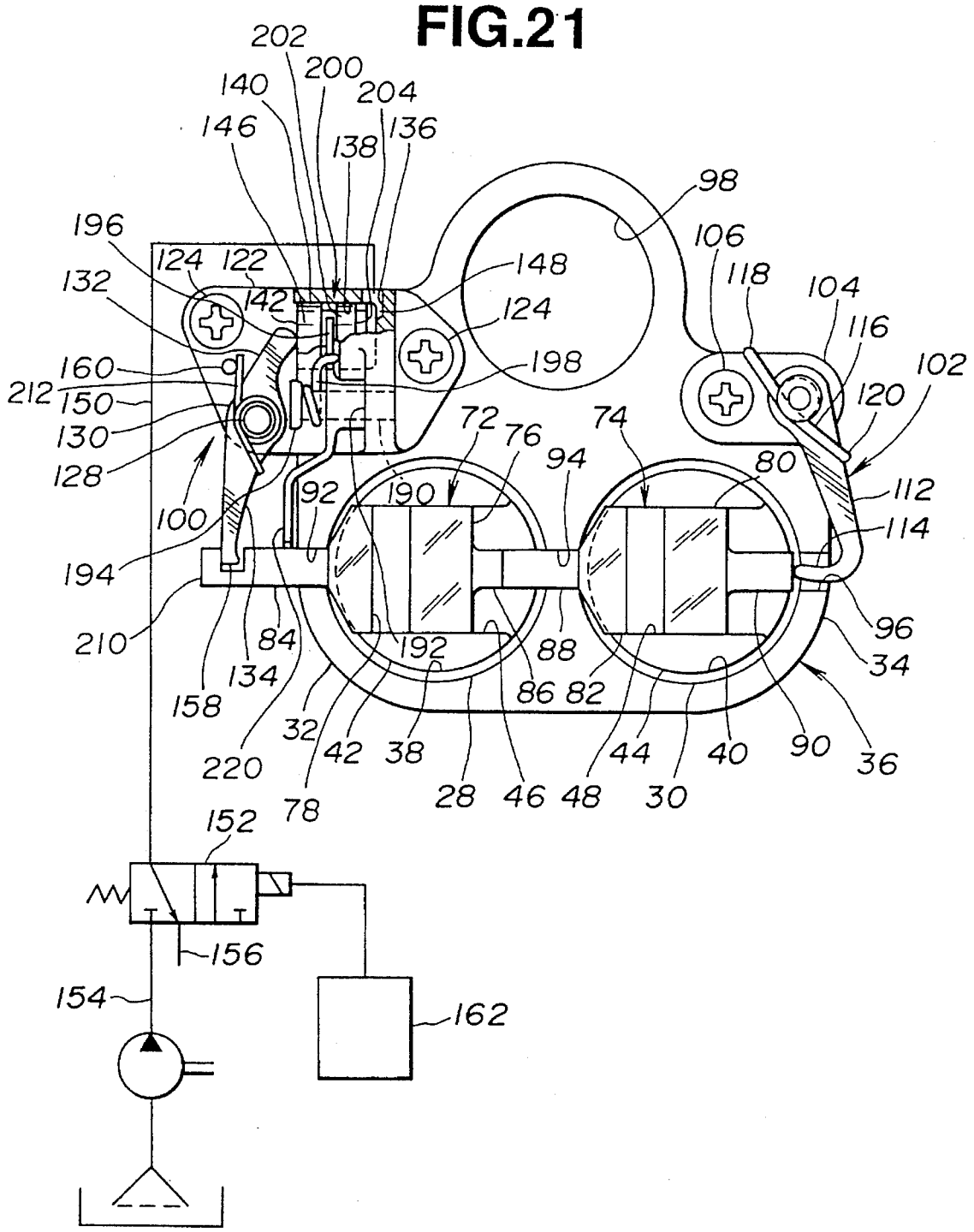
FIG. 21, 22 and 23 show a fifth embodiment of the valve drive similar to FIG. 12, 13 and 14, respectively.
Figure 22:
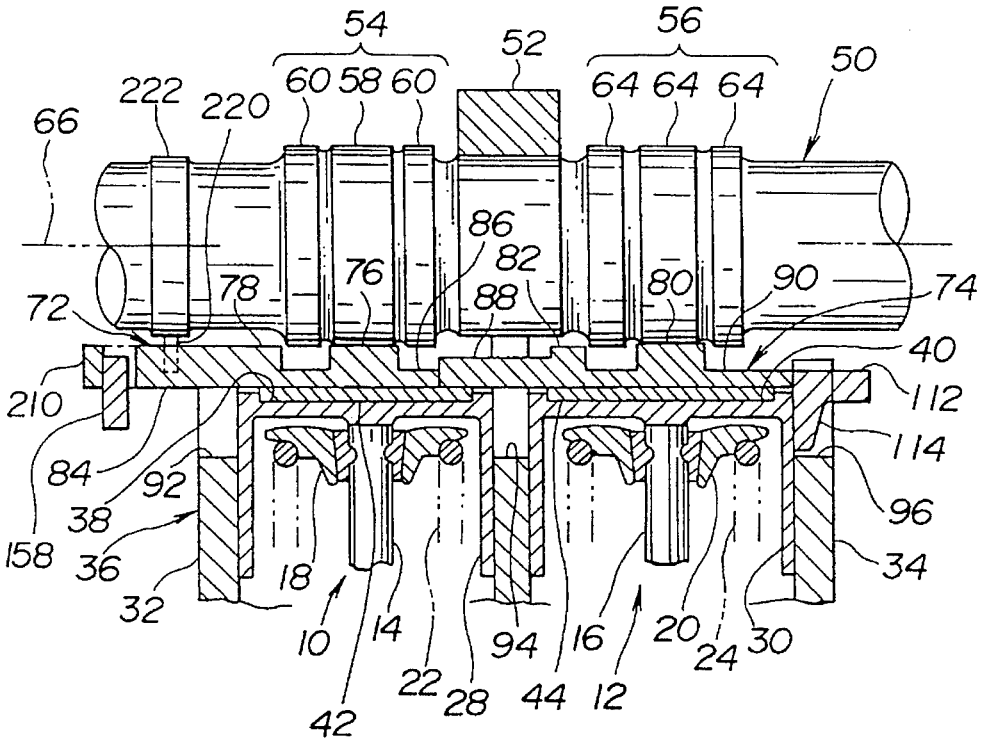
Figure 23:
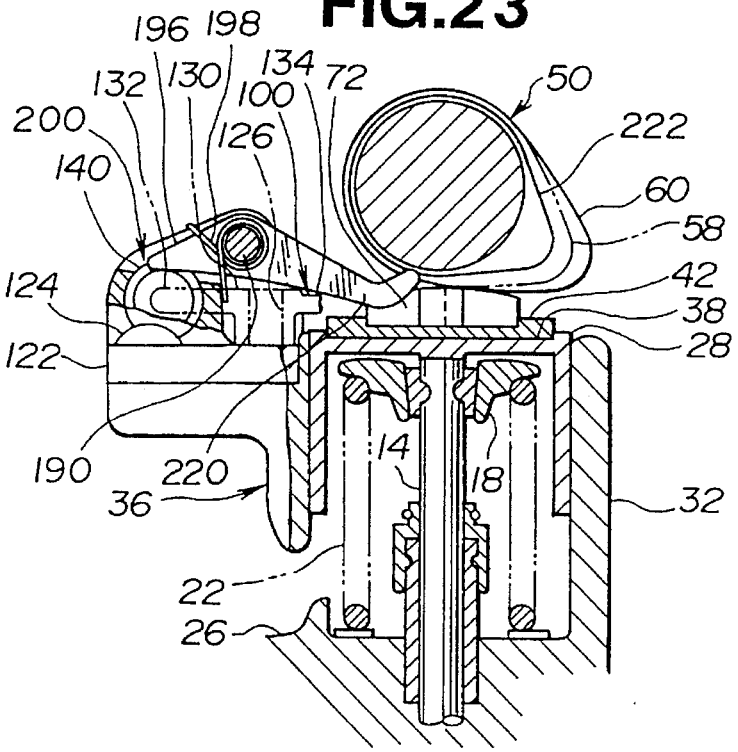

Referring to FIGS. 21 to 23, the fifth embodiment is substantially the same as the fourth embodiment. However, this fifth embodiment is different from the fourth embodiment in the manner of lifting or disengaging a restraining arm 196 from an armrest 200. As best seen in FIGS. 22 and 23, a handle 220 integral with the arm 196 has a leading end portion held in slidable engagement with a timing cam lobe 222 on a camshaft 50.

In operation of the fifth embodiment, the timing cam lobe 222 actuates the arm 196 through the handle 220 in the same manner as the rod 84 actuates the arm 196 through the handle 208 in the fourth embodiment.

Referring lastly to FIGS. 24 to 29, the sixth embodiment is described. This sixth embodiment is substantially the same as the first embodiment, but different therefrom in the provision of a hydraulic mechanism for restraining an undesired shift of a train of cam followers 72 and 74 when valve lifters 28 and 30 are unlifted.

Figure 24:
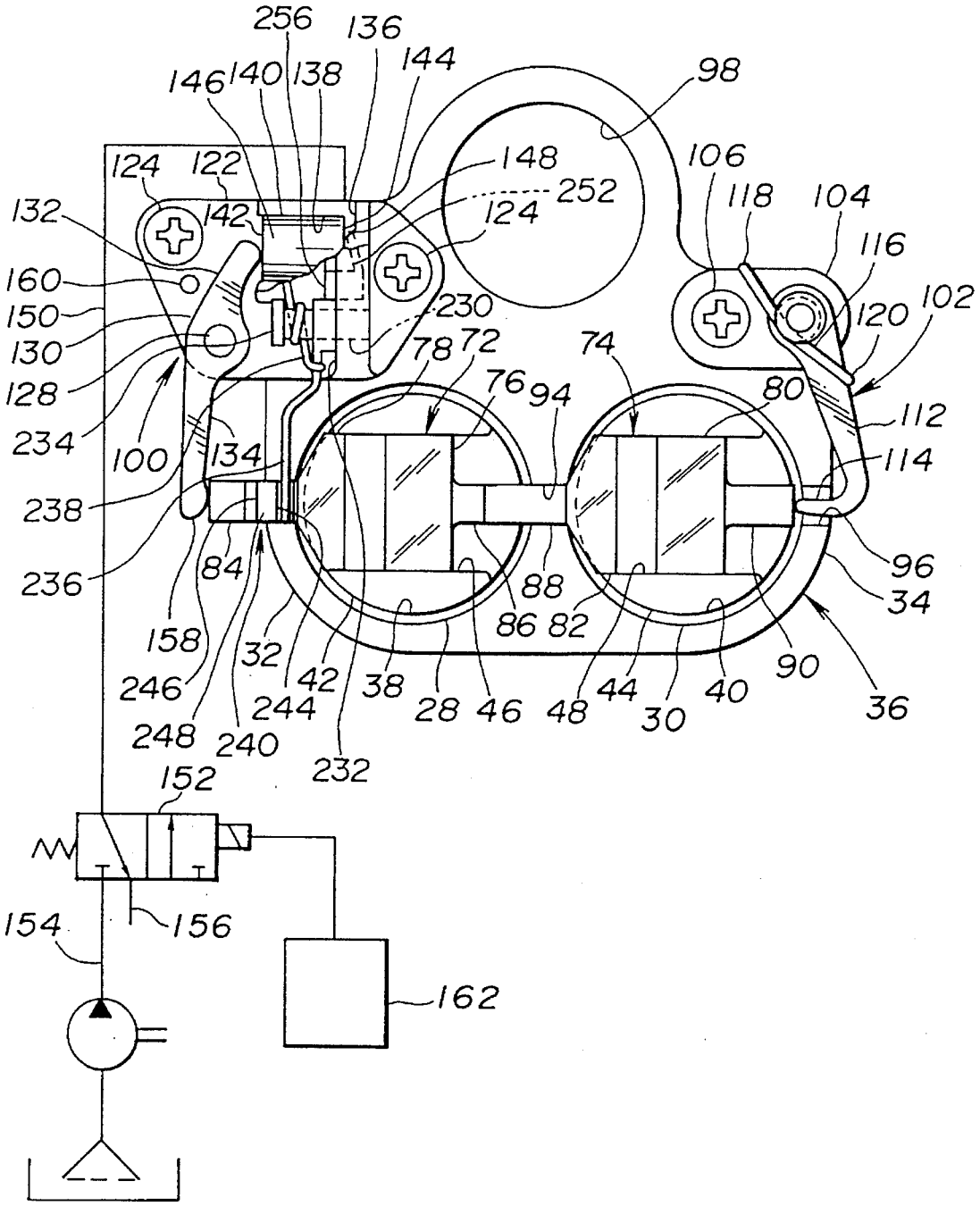
FIGS. 24, 25 and 26 show a sixth embodiment of the valve drive similar to FIG. 12, 13 and 14, respectively.
Figure 25:
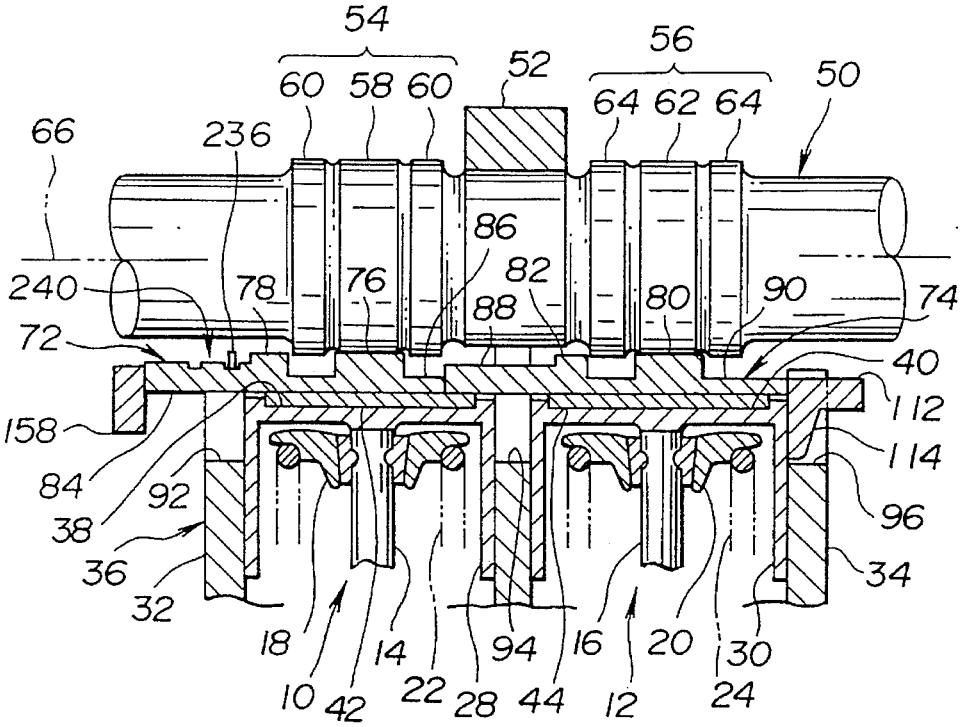
Figure 26:
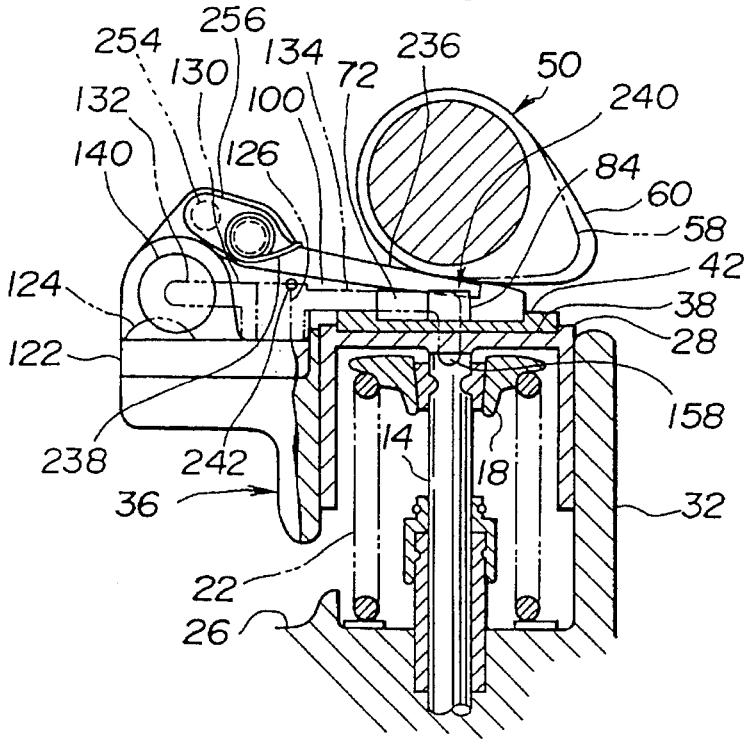
Figure 27:
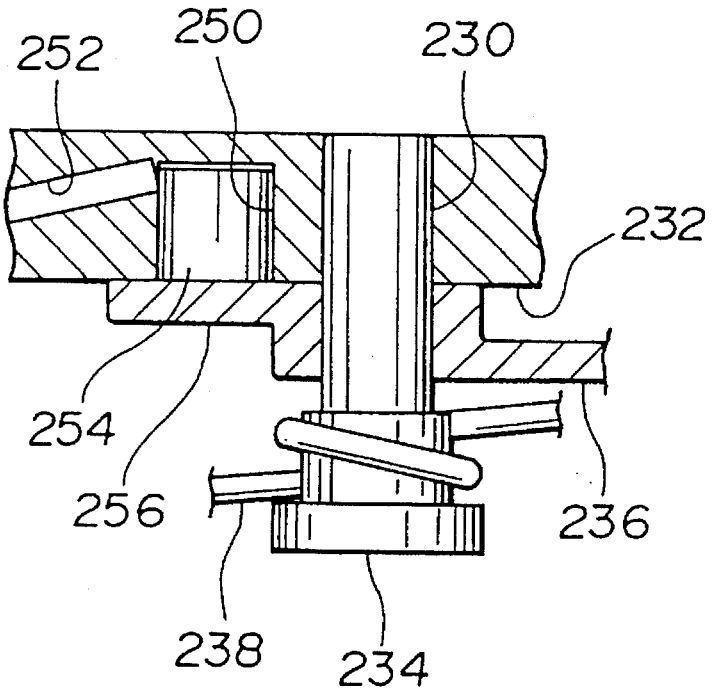
FIG. 27 is an enlarged fragmentary view of FIG. 24, partly sectioned, to show a mechanism to displace an arm.

Referring to FIGS. 24, 26 and 27, a support 122 of an actuator 100 has a short rod 230 adjacent a piston 140. The short rod 230 has one end fixed to a standing wall 232 of the support 122 and lies in parallel to an axis 66 of a camshaft 50. At the opposite end, the short rod 230 carries a head 234. Supported by the short rod 230 is a restraining arm 236. The arm 236 is rotatable about an axis, extending through the center of the short rod 230, parallel to the axis 66 of the camshaft 50. This arm 236 is not only rotatable but also displaceable along the short rod 230. A torsion compression coil spring 238 is carried by the short rod 233 and disposed between the head 234 and arm 236. One end of the torsion coil spring 238 bears against the adjacent wall of the support 122 and the other end thereof is anchored to the arm 236 to bias the arm 236 to an armrest 240 with which a rod 84 of the train of cam followers 72 and 74 is formed. As viewed from FIG. 26, the torsion coil spring 238 imparts a clockwise torque to the arm 236 and a stop pin 242 is arranged to limit downward movement of the arm 236. The torsion coil spring 238 is compressed between the head 234 and the arm 236 to bias the arm 236 against the standing wall 232 (see FIGS. 24 and 27). The armrest 240 includes an axially spaced two faces, a first or inner face 244 and a second or outer face 246, and a portion 248 of the upper portion, as viewed from FIG. 25, of the rod 84 of the train of cam followers 72 and 74 defined between the inner and outer faces 244 and 246.

As best seen in FIG. 27, the standing wall 232 is formed with a blind bore 250 communicating through a passage 252 with a hydraulic chamber 148 to which a piston 140 is exposed. A piston 254 is slidably received in the blind bore 250 and has an inner end wall subjected to oil pressure supplied to the blind bore 250 through the passage 252. The arm 236 has an integral plate 256 brought into slidable engagement with the standing wall 232 and the outer end wall of the piston 254 under the bias of the torsion coil spring 238.

In operation of the sixth embodiment, when a solenoid control valve 152 is not energized, the solenoid control valve 152 closes off an oil gallery 154 and opens the hydraulic chamber 148 of the piston 140 to a discharge line 156. Under this condition, the passage 252 communicating with the blind bore 250 for the piston 254 is drained to the discharge line 156 through the hydraulic chamber 148. The torsion coil spring 238 is able to maintain the piston 254 through the integral plate 256 of the arm 236 in the position as illustrated in FIG. 27. A torsion spring 116 of a return mechanism 102 is able to maintain a train of cam followers 72 and 74 in a first position thereof as illustrated in FIG. 24. In this first position, an inner arm 132 of a lever 130 is able to maintain the piston 140 in the position as illustrated in FIGS. 24 and 25.

Let us assume that the solenoid control valve 152 is energized to close off the discharge line 156 and to open the oil gallery 154 to supply oil under pressure to the hydraulic chamber 148 and to the blind bore 250 through the passage 252 when the arm 236 is in opposed relation with the inner face of the armrest 240 with valve lifters 28 and 30 unlifted. The oil pressure in the hydraulic chamber 148 urges the piston 140 to move out of bore 138, and the oil pressure in the blind bore 250 urges the piston 248 to move out of the blind bore 250. Thus, both of the pistons 140 and 248 tend to move out of the bores 138 and 250, respectively. However, this tendency is restrained by engagement of the arm 236 with the inner face 244 of the armrest 240. Thus, the train of cam followers 72 and 74 remains in the first position thereof.

As the low speed cam lobes 58 and 62 begin to lift the valve lifters 28 and 30 against valve springs 22 and 24, the rod 84 moves down to cause the armrest 240 to disengage from the arm 236 since the stop pin 242 prevents downward movement of the arm 236. This allows movement of the piston 254 in response to the oil pressure in the bore 250. This movement of the piston 254 against the bias of the torsion coil spring 238 causes displacement of the arm 236 relative to the armrest 240. Since the train of cam followers 72 and 74 is biased by the valve springs 22 and 24 against the low speed cam lobes 58 and 62 and stays immoble from the first position thereof, the lever 130 stays in the position as illustrated in FIG. 24, causing the inner arm 132 to maintain the piston 140 in the position as illustrated in FIG. 24.

Figure 28:
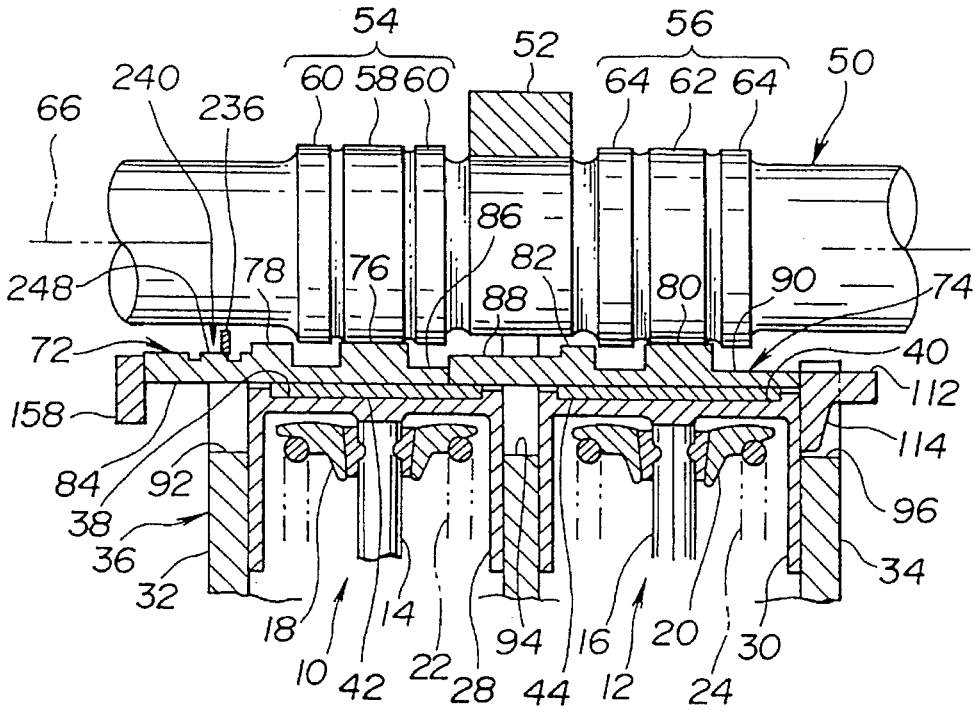
FIG. 28 is a view similar to FIG. 25 and shows position of the parts when the valve lifters are about to enter "unlifted" phase after shifting means has been urged to shift the train of cam followers from the first position thereof to the second position thereof so that the train of cam followers is ready to move to the second position thereof upon the valve lifter entering the "unlifted" phase.

Immediately before the moment when the valve lifters 28 and 30 are unlifted again, the arm 236 rests on the armrest 240 out of opposed relation with the inner face 244 as illustrated in FIG. 28. The arm 236 is biased into engagement with the armrest 240 due to the torsion coil spring 238. However, this engagement of the arm 236 with the armrest 240 does not hamper movement of the rod 84.

At or immediately after the valve lifters 28 and 30 are unlifted again, the train of cam followers 72 and 74 is rendered mobile from the first position thereof, allowing the piston 140 to move further out of the bore 138 due to the oil pressure in the hydraulic chamber 148. This allows turning of the lever 130, causing a finger 158 of an outer arm 134 of the lever 130 to move the train of cam followers 72 and 74, against the bias of a torsion spring 116 of the return mechanism 102, to a second position thereof (see FIG. 29). Further movement of the train of cam followers 72 and 74 beyond this second position is limited by abutting engagement of the inner arm 132 with a stop pin 160. During this movement, the arm 236 slides on the armrest 240 until it is brought into opposed relation with the outer face 246 of the armrest 240. In the second position, the main and auxiliary lands 76 and 78 of the cam follower 72 are in driving relation with a pair of high speed cam lobes 60, respectively, and main and auxiliary lands 80 and 82 of the cam follower 74 are in driving relation with a pair of high speed cam lobes 64, respectively (see FIG. 29).

Next, let us assume that the solenoid control valve 152 is de-energized when the train of cam followers 72 and 74 is in the second position thereof and the arm 236 is in opposed relation with the outer face 246 of the armrest 240 with the valve lifters 28 and 30 unlifted. The hydraulic chamber 148 is opened to the discharge line 156, and the passage 252 and the bore 250 are drained. The pistons 140 and 254 are rendered mobile. However, the arm 236 is engagement with the outer face 246 of the armrest 240. Thus, the train of cam followers 72 and 74 remains in the second position thereof.

As the high speed cam lobes 60 and 64 begin to lift the valve lifters 28 and 30 against the valve springs 22 and 24, the rod 84 moves down, allowing the arm 236 to disengage from the outer face 246 of the armrest 240 and to displace relative to the armrest 240 due to the bias of torsion coil spring 238. Specifically, the arm 236 is displaced to the position as illustrated in FIG. 27. The train of cam followers 72 and 74 stays immobile from the second position thereof due to the valve springs 22 and 24.

Figure 29:
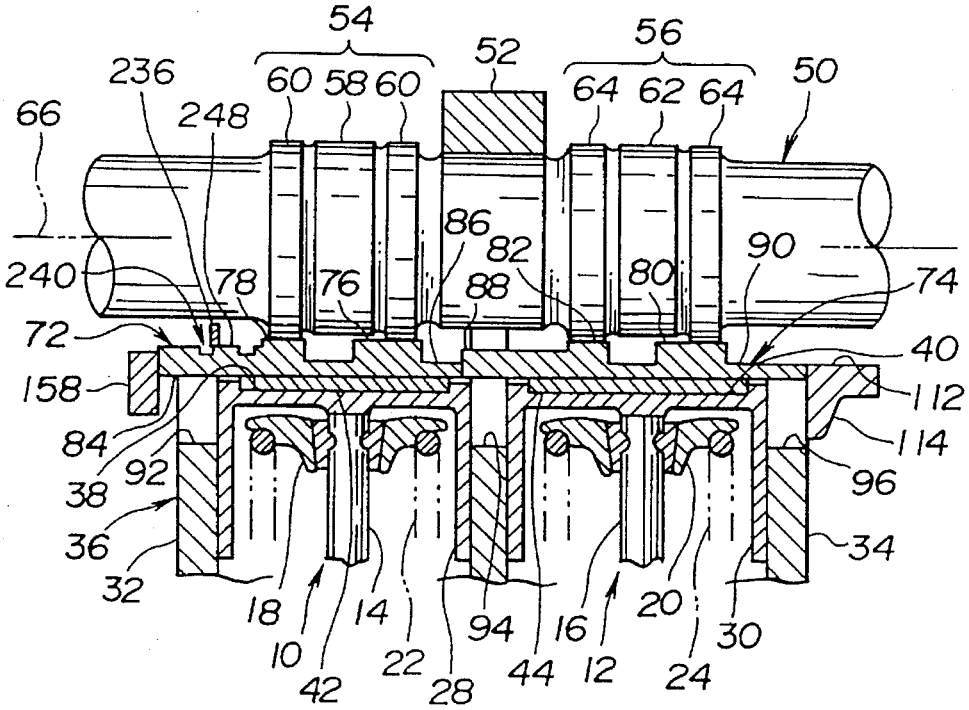
FIG. 29 is a view similar view to FIG. 25 and shows the position of parts when the valve lifters are about to enter "unlifted" phase after shifting means has been urged to shift the train of cam followers from the second position thereof back to the first position thereof so that the train of cam followers is ready to move back to the first position thereof upon the valve lifters entering the "unlifted" phase.

Immediately before the moment when the valve lifters 28 and 30 are unlifted again, the arm 236 rests on the armrest 240 out of opposed relation with the outer face 246 as illustrated in FIG. 29. The arm 236 is biased into engagement with the armrest 240 due to the torsion coil spring 238.

At or immediately after the valve lifters 28 and 30 are unlifted again, the train of cam followers 72 and 74 is rendered mobile from the second position thereof, allowing the torsion spring 116 to move the train of cam followers 72 and 74 from the second position thereof to the first position thereof (see FIG. 24). During this movement of the train of cam followers 72 and 74, the lever 130 turns clockwise to the position illustrated in FIG. 24, moving the piston 140 into the bore 138 to the position as illustrated in FIG. 24.

Valve trains described with regard to the previous embodiment use solid valve lifter. The invention, however, may De applicable to valve trains using hydraulic lifters.

What is claim:

1. A valve drive for an internal combustion engine, comprising:

a cylinder valve having a stem;

a valve spring biasing said cylinder valve toward a closed position thereof;

a camshaft rotatable about an axis and carrying a set of different cam lobes, including a first cam lobe and a second cam lobe;

a valve train operable in a first state to transfer a rotational motion of said first cam lobe to a reciprocating motion of said cylinder valve against said valve spring, said valve train being also operable in a second state to transfer rotational motion of said second cam lobe to a reciprocating motion of said cylinder against said valve spring, wherein said valve train includes a cam follower arranged to move along a line parallel to said cam shaft axis between a first position in which said cam follower is in driving relation with said first cam lobe and a second position in which said cam follower is in driving relation with said second cam lobe, wherein said valve train includes a valve lifter guide structure with a valve lifter guide, and a valve lifter reciprocatingly received in said valve lifter guide to operate said cylinder valve against said valve spring, and wherein said valve lifter has a top formed with a pocket, a disc snugly fit in said pocket, and wherein said disc is formed with groove means for receiving said cam follower for movement between said first and second position thereof; and means for shifting said cam follower between said first and second positions thereof.

2. A valve drive as claimed in claim 1, wherein said set of different cam lobes includes a third cam lobe identical to said second cam lobe and axially spaced therefrom along said axis of said camshaft, wherein said first cam lobe is situated between said axially spaced second and third cam lobes.

3. A valve drive as claimed in claim 2, wherein said cam follower has two spaced main and auxiliary lands.

4. A valve drive as claimed in claim 3, wherein said main land has a top surface adapted to slide on said first cam lobe or said third cam lobe, and said auxiliary land has a top surface adapted to slide on said second cam lobe.

5. A valve drive as claimed in claim 3, wherein, when said cam follower is in said first position thereof, said main land is in driving relation with said first cam lobe and said auxiliary land is out of driving relation with said second and third cam lobes.

6. A valve drive as claimed in claim 5, wherein, when said cam follower is in second position thereof, said main land is out of driving relation with said first cam lobe and said main and auxiliary lands are in driving relation with said second and third cam lobes.

7. A valve drive as claimed in claim 6, wherein said top surface of said main land is bounded by two straight sides spaced along a line parallel to said axis of said camshaft and two parallel sides spaced perpendicularly to said line parallel to said axis of said camshaft and interconnecting said two straight sides.

8. A valve drive as claimed in claim 7, wherein said cop surface of said auxiliary land is bounded by two straight sides spaced along said line parallel to said axis of said camshaft, said two straight sides including a shorter straight side.

9. A valve drive as claimed in claim 8, wherein said top surface of said auxiliary land is bounded also by two parallel sides spaced perpendicularly to said line parallel to said axis of said camshaft and two angled sides, one of said two angled sides being connected between said shorter straight side and one of said two parallel sides, the other of said two angled sides being connected between said shorter straight side and the other of said two parallel sides.

10. A valve drive as claimed in claim 9, wherein said valve lifter guide receives both of said main and auxiliary lands during reciprocating motion of said valve lifter.

11. A valve drive as claimed in claim 3, wherein said cam follower has a first rod projecting from said auxiliary land and a second rod projecting from said main land, said first and second rods being aligned along said line parallel to said axis of said camshaft.

12. A valve drive as claimed in claim 11, wherein said valve lifter guide is formed with cut means for allowing the passage of at least one of said first and second rods during reciprocating motion of said cam follower together with said valve lifter.

13. A valve drive as claimed in claim 7, wherein said top surface of said auxiliary land is bounded by two straight sides spaced among said line parallel to said axis of said camshaft and two parallel sides spaced perpendicularly to said line parallel to said axis of said camshaft.

14. A valve drive as claimed in claim 13, wherein said valve lifter guide is formed with a recess receiving said auxiliary land during reciprocating motion of said valve lifter.

15. A valve drive for an internal combustion engine, comprising:

a cylinder valve having a stem;

a valve spring biasing said cylinder valve toward a closed position thereof;

a camshaft rotatable about an axis and carrying a set of different cam lobes, including a first cam lobe and a second cam lobe;

a valve train operable in a first state to transfer a rotational motion of said first cam lobe to a reciprocating motion of said cylinder valve against said valve spring, said valve train being also operable in a second state to transfer rotational motion of said second cam lobe to a reciprocating motion of said cylinder valve against said valve spring, wherein said valve train includes a cam follower arranged to move between a first position in which said cam follower is in driving relation with said first cam lobe and a second position in which said cam follower is in driving relation with said second cam lobe;

means for shifting said cam follower between said first and second positions thereof, wherein said shifting means includes an actuator operable to urge said cam follower to said second position and a return mechanism biasing said cam follower to said first position thereof; and means for restraining said cam follower from movement when said valve lifter is lifted, but allowing said cam follower to move when said valve lifter is subsequently unlifted after said shifting means has been urged to shift said cam follower.

16. A valve drive for an internal combustion engine, comprising:

a cylinder valve having a stem;

a valve spring biasing said cylinder valve toward a closed position thereof;

a camshaft rotatable about an axis and carrying a set of different cam lobes, including a first cam lobe and a second cam lobe;

a valve train operable in a first state to transfer a rotational motion of said first cam lobe to a reciprocating motion of said cylinder valve against said valve spring, said valve train being also operable in a second state to transfer rotational Motion of said second cam lobe to a reciprocating motion of said cylinder valve against said valve spring, wherein said valve train includes a cam follower arranged to move between a first position in which said cam follower is in driving relation with said first cam lobe and a second position in which said cam follower is in driving relation with said second cam lobe;

means for shifting said cam follower between said first and second position thereof, wherein said shifting means includes an actuator operable to urge said cam follower to said second position and a return mechanism biasing said cam follower to said first position thereof; and means for restraining said shifting means from movement upon said shifting means being urged to shift said cam follower when said valve lifter is lifted, but subsequently allowing said shifting means to shift said cam follower when said valve lifted is subsequently unlifted.

17. A valve drive for an internal combustion engine, comprising:

a cylinder valve having a stem;

a valve spring biasing said cylinder valve toward a closed position thereof;

a camshaft rotatable about an axis and carrying a set of different cam lobes, including a first cam lobe and a second cam lobe;

a valve train operable in a first state to transfer a rotational motion of said first cam lobe to a reciprocating motion of said cylinder valve against said valve spring, said valve train being also operable in a second state to transfer rotational motion of said second cam lobe to a reciprocating motion of said cylinder valve against said valve spring, wherein said valve train includes a cam follower arranged to move between a first position in which said cam follower is in driving relation with said first cam lobe and a second position in which said cam follower is in driving relation with said second cam lobe, and wherein said valve train includes a valve lifter guide structure with a valve lifter guide, and a valve lifter reciprocatingly received in said valve lifter guide to operate said cylinder valve against said valve spring; and means for shifting said cam follower between said first and second positions thereof, wherein said shifting means includes an actuator operable to urge said cam follower to said second position and a return mechanism biasing said cam follower to said first position thereof, wherein said return mechanism includes a first support attached to said valve lifter guide structure, a return arm supported by said first support and projecting from said first support and terminating in an insert, and spring means for imparting a torque to said return arm, causing said insert to bias said cam follower to said first position thereof.

18. A valve drive as claimed in claim 17, wherein said actuator has a second support attached to said valve lifter guide structure, a lever supported by said second support, and a piston received in a bore of said second support, said lever including an inner arm cooperating with said piston and an outer arm projecting outwardly from said second support, said outer arm of said lever including a finger cooperating with said cam follower.

19. A valve drive as claimed in claim 18, wherein said actuator also includes a stop pin, on said second support, arranged to abut on said inner arm of said lever to limit rotation of said lever thereby to define said second position of said cam follower.

20. A valve drive as claimed in claim 15, wherein said valve train includes a valve lifter guide structure with a valve lifter guide, and a valve lifter reciprocatingly received in said valve lifter guide to operate said cylinder valve against said valve spring.

21. A valve drive as claimed in claim 20, wherein said actuator has a support attached to said valve lifter guide structure, a lever supported by said support, and a piston received in a bore of said support, said lever including an inner arm cooperating with said piston and an outer arm projecting outwardly from said support, said outer arm of said lever including a finger cooperating with said cam follower.

22. A valve drive as claimed in claim 21, wherein said cam follower has a rod cooperating with said finger.

23. A valve drive as claimed in claim 22, wherein said restraining means include:

a restraining arm supported by said support of maid actuator;

an armrest with which said piston is formed, said armrest including spaced first and second faces;

spring means for biasing said restraining arm towards said armrest;

said restraining arm being brought into opposed relation with said first face of said armrest when said cam follower is in said first position thereof with said valve lifter unlifted, thereby to hold said cam follower In said first position thereof, said restraining arm being brought into opposed relation with said second face of said armrest when said cam follower is in said second position thereof with said valve lifter unlifted, thereby to hold said cam follower in said second position thereof, means for disengaging said restraining arm and said armrest from each other when said valve lifter is lifted; and means for causing limited displacement of said armrest relative to said restraining arm when said valve lifter is lifted immediately after said shifting means was urged to shift said cam follower with said valve lifter unlifted.

24. A valve drive as claimed in claim 23, wherein said means for causing limited displacement include:

an integral stop of said rod of said cam follower, said integral stop cooperating with said finger of said outer arm of said lever; and spring means for biasing said finger to said integral stop and said outer arm to said piston, thereby to provide a lost motion connection between said piston and said cam follower.

25. A valve drive as claimed in claim 24, wherein said disengaging means includes:

a handle integral with said restraining arm and extending into the path of reciprocating motion of said rod of said cam follower.

26. A valve drive as claimed in claim 24, wherein said disengaging means include:

a timing cam lobe of said camshaft; and a handle integral with said restraining arm and having a leading end portion in slidable engagement with said timing cam lobe.

27. A valve drive as claimed in claim 22, wherein said restraining means include:

a restraining arm supported by said support of said actuator; an armrest with which said rod of said cam follower is formed, said armrest including spaced first and second faces;

spring means for biasing said restraining arm towards said armrest;

said restraining arm being brought into opposed relation with said first face of said armrest when said cam follower is in said first position thereof with said valve lifter unlifted, thereby to hold said cam follower in said first position thereof, said restraining arm being brought into opposed relation with said second face of said armrest when said cam follower is in said second position thereof with said valve lifter unlifted, thereby to hold said cam follower in said second position thereof, means for disengaging said restraining arm and said armrest from each other when said valve lifter is lifted; and means for causing limited displacement of said armrest relative to said restraining arm when said valve lifter is lifted immediately after said shifting means was urged to shift said cam follower with said valve lifter unlifted.

28. A valve drive as claimed in claim 27, wherein said disengaging means is a stop pin arranged to abut said restraining arm.

29. A valve drive as claimed in claim 27, wherein said means for causing limited displacement includes a second piston received in a second bore of said support of said actuator, said second bore being connected to said bore in which said piston is received, said second piston being arranged to displace said restraining arm against said spring means.

30. A valve drive as claimed in claim 29, wherein said spring means is a torsion coil spring.

* * * * *